United States Patent [19]

Ichigo et al.

[11] 3,960,108

[45] June 1, 1976

[54] SPRAY COATING APPARATUS

[75] Inventors: Minoru Ichigo, Nagoya; Takeshi Suzuki, Inuyama; Katsumasa Harada, Komaki, all of Japan

[73] Assignee: Kikusui Kagaku Kogyo Kabushiki Kaisha, Japan

[22] Filed: Mar. 7, 1974

[21] Appl. No.: 448,866

[30] Foreign Application Priority Data

| | | |
|---|---|---|
| Mar. 12, 1973 | Japan | 48-28800 |
| July 5, 1973 | Japan | 48-76419 |
| Sept. 14, 1973 | Japan | 48-104239 |
| Oct. 11, 1973 | Japan | 48-114163 |

[52] U.S. Cl. ..... 118/324; 118/DIG. 16; 427/424

[51] Int. Cl.[2] ..... B05C 5/00

[58] Field of Search .... 118/300, 324, 261, DIG. 16, 118/259, 429, 261

[56] References Cited

UNITED STATES PATENTS

| | | | |
|---|---|---|---|
| 1,616,724 | 2/1927 | Weber | 118/261 |
| 2,096,026 | 10/1937 | Belluche | 118/324 X |
| 2,876,039 | 3/1959 | Vogdt | 118/300 X |
| 3,044,442 | 7/1962 | Pott | 118/DIG. 16 |
| 3,527,580 | 9/1970 | Bonlie | 118/300 X |

FOREIGN PATENTS OR APPLICATIONS

| | | | |
|---|---|---|---|
| 243,892 | 4/1963 | Australia | 118/300 |
| 552,655 | 4/1943 | United Kingdom | 118/324 |

*Primary Examiner*—Louis K. Rimrodt
*Attorney, Agent, or Firm*—Ladas, Parry, Von Gehr, Goldsmith & Deschamps

[57] ABSTRACT

For coating the surfaces of various materials with a paint or like coating liquid, use is made of a spray roll typically having bristles in the form of steel wires or the like implanted in the cylindrical surface of a cylindrical core in dense, radial arrangement. A supply plate which may be of flat, elongated shape is disposed tangentially of the spray roll so as to be in substantial contact therewith at least along one of its longitudinal edges. Hence, by continuously delivering the coating liquid onto the supply plate in the form of a layer of uniform thickness while the spray roll is in rotation in a prescribed direction, the coating liquid can be sprayed onto the work which may be traveling at a constant speed in a direction at right angles to the axis of the spray roll. Several examples of the spray coating apparatus are disclosed on the basis of these fundamental concepts of the invention.

8 Claims, 23 Drawing Figures

FIG. 9
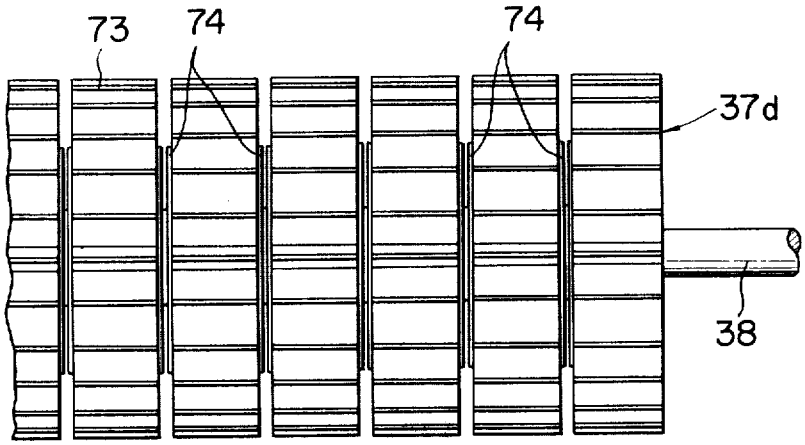
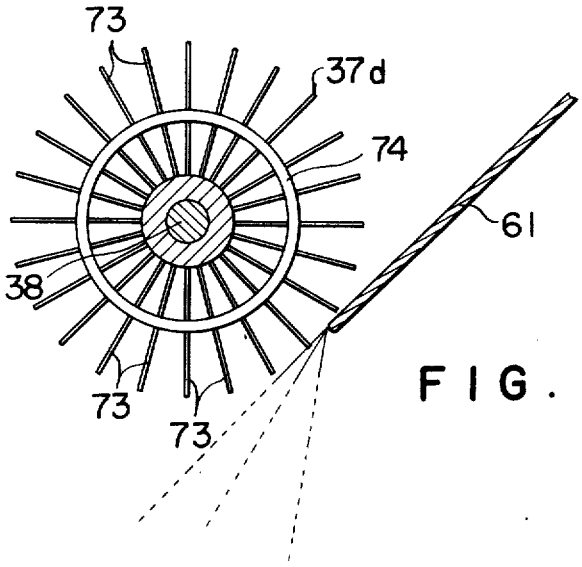
FIG. 10

SPRAY COATING APPARATUS

BACKGROUND OF THE INVENTION

This invention relates generally to the art of surface coating, and more specifically to a method and apparatus for spray coating of surfaces with fine droplets of paints or the like produced by a rotating spray roll.

Heretofore, for coating the surfaces of structural parts and various other objects, spray guns have been used extensively for the relative ease of coating operation and the uniformity of the coatings obtained. The use of the spray guns is disadvantageous, however, in that they must be connected to a source of compressed air via pressure conduits which can greatly hamper their portability and hence the coating operation itself. Moreover, the paint or like coating agent sprayed by the spray guns are not necessarily neatly applied to the desired surfaces only, and the particles of the sprayed coating agent can further pollute the ambient air. This is highly objectionable from the viewpoint of hygiene for the workmen and of the economical use of the coating agent.

Other conventional coating methods involve the use of rollers, doctor blades or the like. While various surfaces can be coated neatly and with uniform thickness according to these known methods, they are quite ineffective to cause variations in the appearance, pattern or other properties of the coatings.

SUMMARY OF THE INVENTION

In view of the listed disadvantages of the prior art, it is an object of this invention to provide a novel and improved method and apparatus for spray coating of surfaces without use of pneumatic pressure, whereby various surfaces can be coated neatly and with uniform thickness, with a minimum amount of the coating agent wasted.

Another object of the invention is to provide a spray coating method and apparatus whereby of substantially any shape, size or material can be coated continuously.

A further object of the invention is to provide a spray coating method and apparatus which permits the use of paints or like coating liquids of any composition and in a wide range of viscosity, whether or not they contain aggregates, fillers or other additives.

A further object of the invention is to provide a spray coating apparatus which permits selective coating of specific surface portions only, or of the entire surface of the work which is considerably smaller than that of standard dimensions.

A further object of the invention is to provide a spray coating apparatus whereby the general appearance, thickness or other characteristic of the coatings can be easily varied.

A still further object of the invention is to provide a spray coating apparatus which can be constructed relatively inexpensively but which operates continuously for prolonged lengths of time with a minimum degree of maintenance.

In the spray coating method of this invention, there is used a spray roll comprising a cylindrical core and a number of resilient elements of slender shape extending radially from the circumference of the cylindrical core. A supply plate is mounted along the spray roll so as to be held in substantial contact therewith at least along one edge. For spray coating operation a coating liquid is delivered continuously onto the supply plate so that the liquid will flow over the same toward the said one edge thereof in the form of a layer of uniform thickness, and the spray roll is simultaneously revolved to spray the coating liquid onto work away from the supply plate. Typically, the resilient elements constituting parts of the spray roll take the form of bristles made of steel wires or the like of suitable rigidity or resiliency. It will be seen that the above summarized method of the invention underlies all the preferred apparatus embodiments herein disclosed, which essentially differ from each other only as to the means for delivering the coating liquid onto the supply plate.

The features which are believed to be novel and characteristic of this invention are set forth with particularity in the appended claims. The invention itself, however, together with the further objects and advantages thereof, will be best understood from the following representation of the several preferred apparatus embodiments taken in conjunction with the accompanying drawings in which like reference characters denote corresponding parts of the several views.

BRIEF DESCRIPTION OF THE DRAWINGS

FIG. 9 is an enlarged, fragmentary view showing a further modified example of the spray roll;

FIG. 10 is a side elevational view showing the modified spray roll shown in FIG. 9 together with the supply plate;

DETAILED DESCRIPTION

Figure 1:
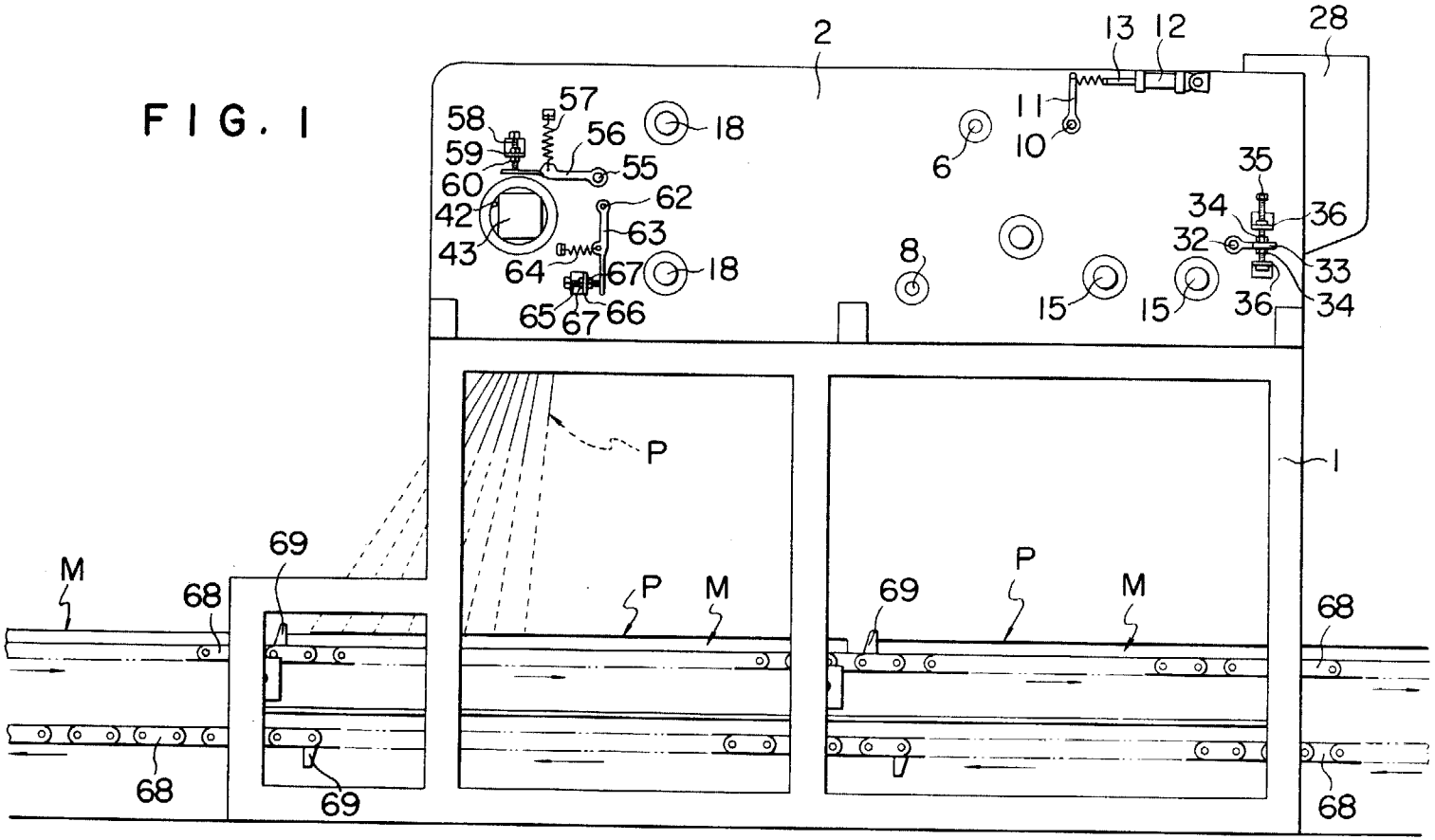
FIG. 1 is a side elevational view of spray coating apparatus constructed in accordance with the concepts of this invention.
Figure 2:
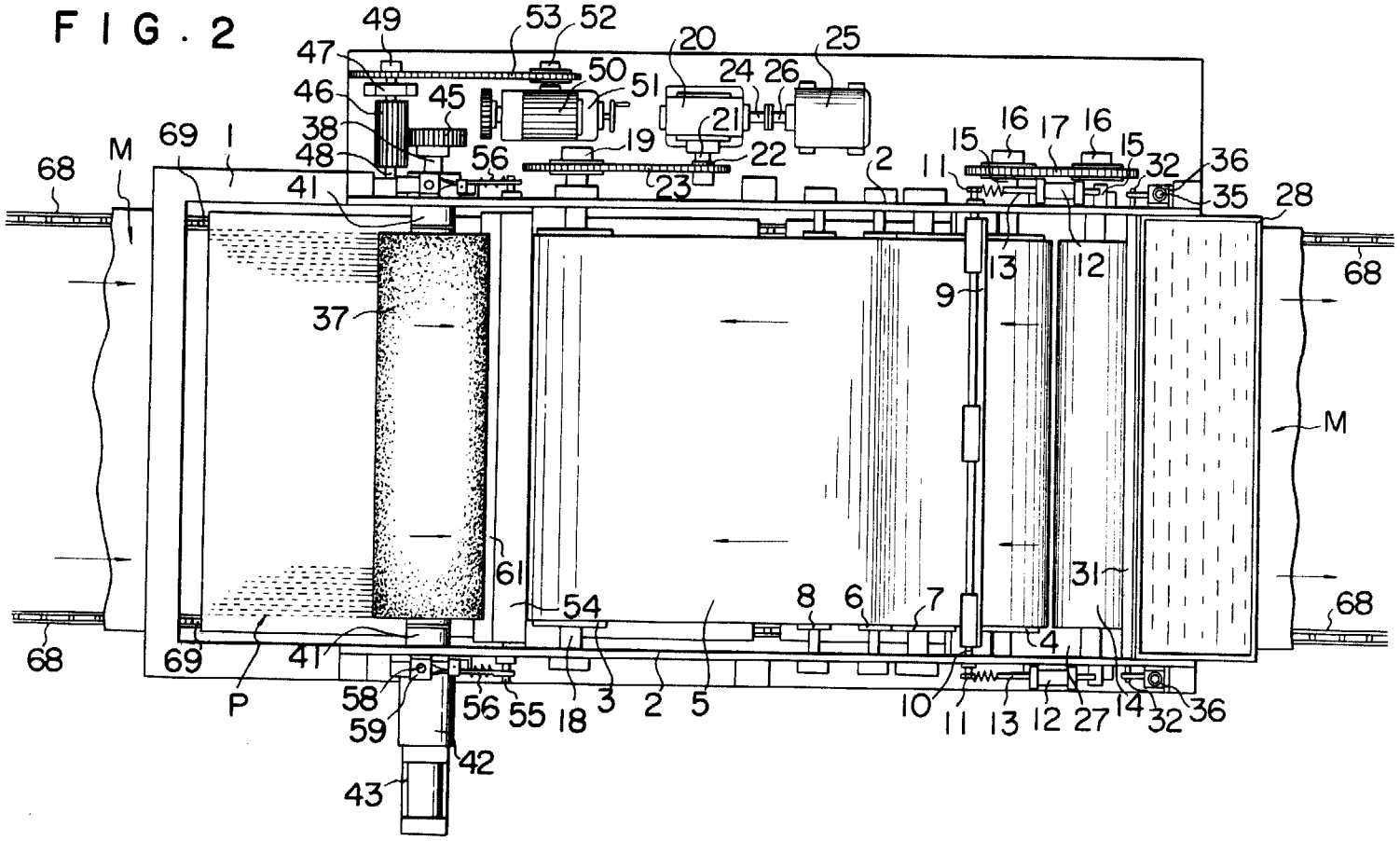
FIG. 2 is a top plan view of the apparatus shown in FIG. 1.
Figure 3:
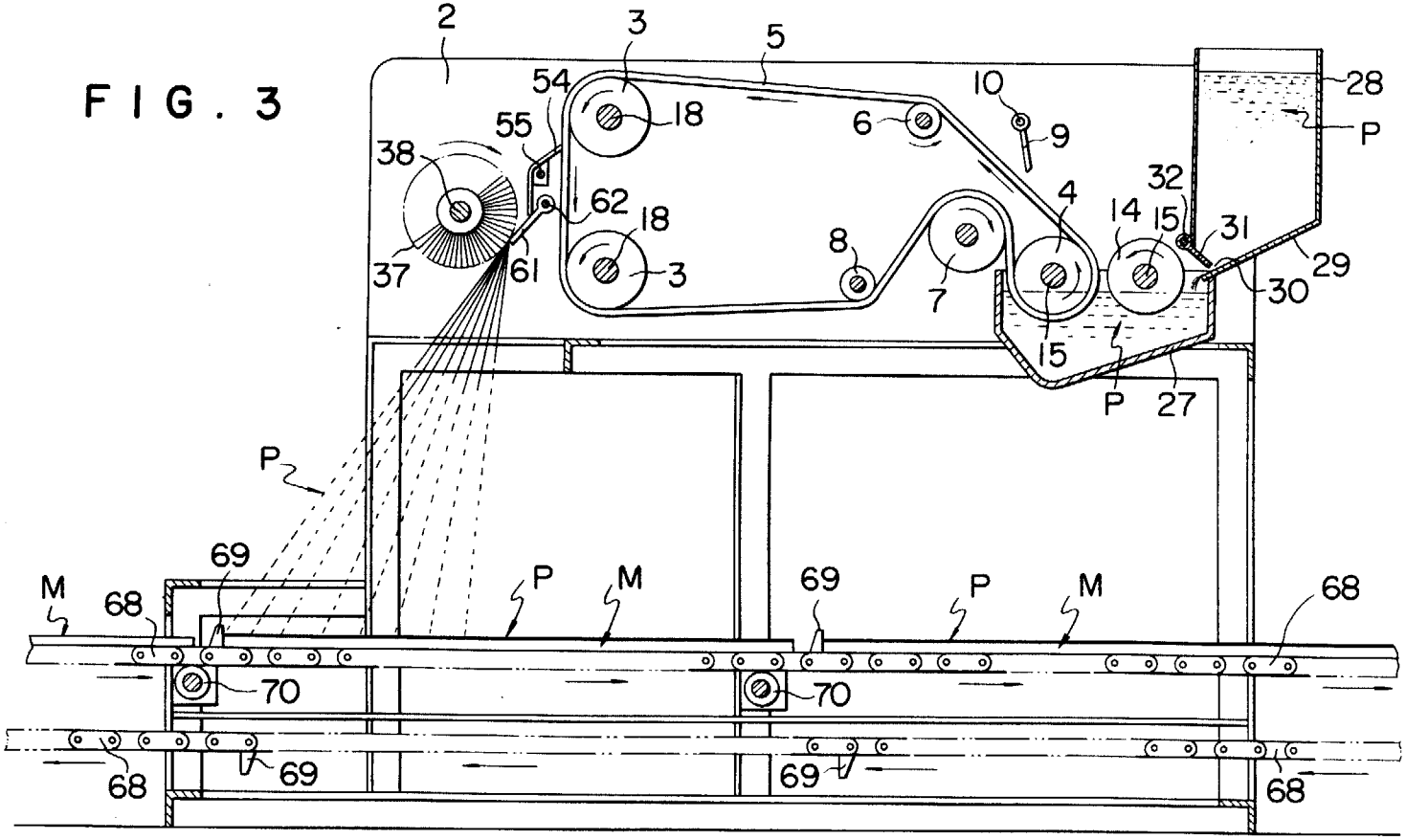
FIG. 3 is a vertical sectional view schematically illustrating the operating principles of the apparatus shown in FIG. 1.

The spray coating apparatus according to the invention will now be described in more detail in terms of a preferred embodiment thereof illustrated in FIGS. 1 through 4. Referring first to FIGS. 1, 2, and 3 in general, reference numeral 1 denotes a supporting frame or structure on which are fixedly mounted a confronting pair of side walls 2. A pair of parallel spaced-apart rolls 3 are rotatably supported in vertical registration between the side walls 2 adjacent their left hand end as viewed in the figures, and a dip roll 4 is rotatably supported between the side walls 2 adjacent their right hand end in substantially coplanar relationship to the lower one of the first mentioned rolls 3.

An endless delivery belt 5 which can be conveniently molded of rubber, synthetic resin or like material extends over the rolls 3 and 4. A guide roll is rotatably supported at 6 between the side walls 2 so that the portion of the delivery belt 5 extending between the dip roll 4 and the guide roll 6 will form a suitably acute angle with respect to the plane of the perpendicular. The underside of the delivery belt 5 is tensed by the provision of a tension roll 7, and another guide roll is provided at 8 so that the delivery belt 5 will be held in contact with the tension roll 7 through a greater angle, the tension roll 7 and the guide roll 8 being both rotatably supported between the side walls 2.

A stopper plate 9 has its upper edge secured to a rod 10 rotatably supported between the side walls 2 so as to be thereby swung into and out of contact with the delivery belt 5 at a point intermediate between the dip roll 4 and the guide roll 6. The rod 10 has its both ends projecting outwardly of the respective side walls 2, and levers 11 are affixed to the projecting ends of the rod 10, respectively. Each of these levers 11 has its free end coupled to the piston rod 13 of an air cylinder 12 supported by each side wall 2.

As best shown in FIG. 3, a splash roll 14 is rotatably supported between the side walls 2 in parallel and coplanar relationship to the dip roll 4 with a suitably narrow spacing therebetween. The dip roll 4 and the splash roll 14 are both fixedly mounted on their respective shafts 15. Sprocket wheels 16 are fixedly mounted on those ends of the respective shafts 15 projecting outwardly of one of the side walls 2, and an endless chain 17 extends over the sprocket wheels 16, so that the dip roll 4 and the splash roll 14 will rotate synchronously as the delivery belt 5 is set in motion by a drive mechanism described hereinbelow.

The drive mechanism of the delivery belt 5 includes a sprocket wheel 19 (FIG. 2) fixedly mounted on one end of a shaft 18 supporting the upper one of the aforesaid pair of vertically registered rolls 3. Another sprocket wheel 22 is fixedly mounted on an output shaft 21 of a reduction gear mechanism 20, and an endless chain 23 extends over these sprocket wheels 19 and 22. The reduction gear mechanism 20 has its input shaft 24 coupled to the output shaft 26 of an electric motor 25 of any known or suitable construction.

As seen in FIG. 3, the aforesaid dip roll 4 and the splash roll 14 are both held at least partly immersed in a paint P or the like in the form of a bulk liquid within an open-top vessel 27 supported between the side walls 2. A supply tank 28 also supported between the side walls 2 is disposed above the vessel 27 and includes a slanting bottom 29 which is open to the vessel 27 via an aperture 30 formed therethrough. The degree of opening of this aperture 30 is regulatable by a shutter plate 31 swingably supported along one edge thereof by a rod 32 rotatably supported between the side walls 2. The rod 32 has both ends thereof projecting outwardly of the side walls 2, and horizontally disposed levers 33 are affixed each at one end to the projecting ends of the rod respectively. As will be understood from FIG. 1, each of the levers 33 is bored at its free end to screw-threadedly receive an adjusting rod 35 therethrough, and a pair of locking nuts 34 are fitted over the adjusting rod 35 to hold the free end of each lever 33 therebetween. The adjusting rod 35 itself is supported by a pair of brackets 36 secured to each side wall 2, in such a manner that the adjusting rod is turnable manually without any axial displacement.

FIGS. 2 and 3 best illustrate a spray roll 37 fixedly supported on a shaft 38 which in turn is rotatably supported between the side walls 2, the spray roll 37 being disposed opposite to that portion of the delivery belt 5 extending between the vertically registered pair of drive and guide rolls 3 with a prescribed spacing therebetween. The spray roll 37 comprises a number of bristles in the form of steel wires implanted in its cylindrical core in dense, radial arrangement.

Figure 4:
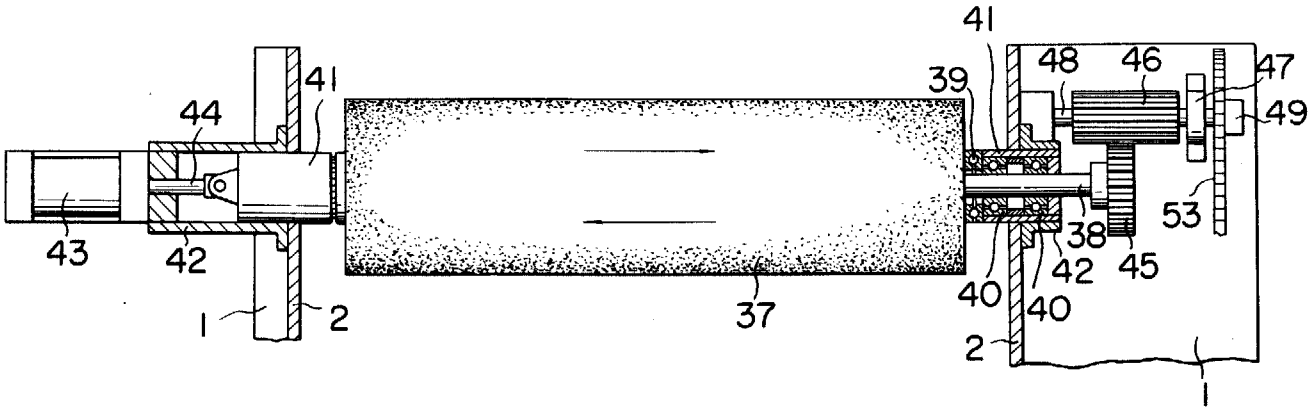
FIG. 4 is an enlarged, fragmentary top plan view, partly in section, of a mechanism for imparting axial reciprocation to a spray roll in the apparatus shown in FIG. 1.

As illustrated in greater detail in FIG. 4, a pair of collars 41 are mounted on both ends of the shaft 38 via thrust bearings 39 and radial bearings 40, respectively. These collars 41 slidably extend through the respective side walls 2 and are further slidably received in their respective guide sleeves 42 affixed to the outside surfaces of the side walls 2. One of the collars 41 is coupled to the piston rod 44 of an air cylinder 43 supported in its illustrated position by the corresponding one of the guide sleeves 42. The spray roll 37 is thus caused to travel back and forth in its axial direction with the motion of the air cylinder 43, as indicated by the arrows in FIG. 4.

As seen in both FIGS. 2 and 4, a gear 45 is fixedly mounted on that end of the shaft 38 projecting out of the other guide sleeve 41 and is meshed with another gear 46 which is suitably elongated axially so as to be held in mesh with the gear 45 regardless of the axial reciprocation of the spray roll 37 and therefore of the shaft 38. The gear 46 is fixedly mounted on a shaft 48 rotatably supported over the supporting frame 1 via bearing means 47. A sprocket wheel 49 is also fixedly mounted on the shaft 48, and an endless chain 53 extends over this sprocket wheel 49 and another sprocket wheel 52 driven by the variable reduction gear mechanism 51 of a second electric motor 50 which can be mounted on the supporting frame 1.

With reference to FIGS. 2 and 3, a scraper plate 54 of substantially V-shaped cross section is fixedly mounted on a rod 55 rotatably supported at both ends by the side walls 2 and extending between the spray roll 37 and that portion of the delivery belt 5 between the vertically registered pair of drive and guide rolls 3. The scraper plate 54 consists essentially of a sloping upper portion adapted for sliding contact with the delivery belt 5 and a vertical lower portion over which the paint scraped from the delivery belt by the sloping upper portion is to stream down. Both ends of the rod 55 project outwardly of the respective side walls 2 and are each securely coupled to one end of a horizontally disposed lever 56, as best seen in FIG. 1. A helical tension spring 57 has its ends connected to the lever 56 and the corresponding one of the side walls 2 so that the sloping upper portion of the scraper plate 54 is yieldably urged against the delivery belt 5. The levers 56 are each further provided with an adjustable stop comprising an adjusting rod 58 screw-threadedly received in a bore formed through a bracket 59 which is secured to each side wall 2 in a position adjacent the corresponding tension spring 57. A pair of locking nuts 60 are fitted over the adjusting rod 58 on both sides of the bracket 59. The degree to which the sloping upper portion of the scraper plate 54 is yieldably forced into contact with the delivery belt 5 can thus be regulated by the manual turn of the adjusting rod 58 relative to the bracket 59 on each side of the side walls 2.

A supply plate 61 is fixedly supported along one edge thereof by a pin 62 rotatably supported at both ends by the side walls 2. As best seen in FIG. 3, the supply plate 61 is located under the vertical lower portion of the scraper plate 54 and is adapted normally to lie in a substantially tangential direction of the spray roll 37 in such a manner that the supply plate will be held in substantial contact with the spray roll at least at its lower edge. Both ends of the pin 62 project outwardly of the respective side walls 2 and, as seen in FIG. 1, are each securely coupled to one end of a vertically disposed lever 63. A helical tension spring 64 has its ends connected to the lever 63 and the corresponding one of the side walls 2 respectively, so that the supply plate 61 has its lower edge portion yieldably urted toward the spray roll 37. In order to regulate the position of the supply plate 61 relative to the spray roll 37, the lever 63 on each end of the pin 62 is further provided with an adjustable stop comprising an adjusting rod 65 screw-threadedly received in a bore formed through a bracket 66 secured to each side wall 2. A pair of locking nuts 67 are fitted over the adjusting rod 65 on both sides of the bracket 66.

Conveyor means in the form of, most appropriately, a pair of parallel spaced-apart endless chains 68 extends through the supporting frame 1 under the delivery belt 5, the brush roll 37 and other working parts of the apparatus mounted on the top of the supporting frame. The endless conveyor chains 68 are equipped with outwardly projecting feed pawls 69 at desired regular spacings, so that sheets of metal or other material M to be coated will be transported successively through the supporting frame 1 as best seen in FIGS. 1 and 3. One or more idler rolls 70 can be rotatably supported by the supporting frame 1 as shown in FIG. 3 to prevent the upper sides of the endless conveyor chains 68 from slackening and sagging.

In operation, the motor 25 is set in motion to impart rotation to the drive roll 3 via the reduction gear mechanism 20, the sprocket wheel 22, the endless chain 23, the sprocket wheel 19, and the shaft 18. The delivery belt 5 thus starts running in the directions of the arrows in FIG. 2, simultaneously setting in rotation the rolls 3, 4, 6, 7 and 8. The resulting rotation of the dip roll 4 is conveyed to the splash roll 14 via the pair of sprocket wheels 16 mounted on their respective shafts 15 and the endless chain 17.

The other motor 50 is also set in motion to impart rotation to the spray roll 37 via the variable reduction gear mechanism 51, the sprocket wheel 52, the endless chain 53, the sprocket wheel 49, the intermeshing gears 45 and 46, and the shaft 38. The spray roll 37 is thus set in rotation in the direction of the arrows in FIGS. 2 and 3.

Since the open-top vessel 27 as well as in the supply tank 28 are assumed to contain the paint P in the form of a bulk liquid, the dip roll 4 and the splash roll 14 are held partly immersed in the paint within the vessel 27 as they rotate on their respective axes as previously mentioned. The paint P is thus coated on the entire outer surface of the delivery belt 5 passing over the dip roll 4, with the aid of the splash roll 14.

The paint P suitable for use in this invention may, for example, be compounded of the following ingredients:

| | |
|---|---|
| Acrylate-vinyl acetate copolymer resin emulsion (50% solid) | 100 parts by weight |
| Calcium carbonate (filler) | 300 parts by weight |
| Titanium oxide | 30 to 50 parts by weight |
| Methylcellulose (to increase viscosity, 3% solid) | 20 parts by weight |
| Sodium hexametaphosphate (10% solid) | 1 part by weight |
| Non-ionic surface-active agent (wetting agent) | 0.3 part by weight |
| Butyl "Carbitol" acetate | 1 to 3 parts by weight |
| Ethylene glycol | 3 parts by weight |

The mixture of the foregoing ingredients is further admixed with 10- to 80-mesh quartz sand as an aggregate in the approximate weight ratio of 1 to 1, the admixture being well intermingled in the presence of water so that the viscosity of the resulting paint, which is white in color, will be in the range of from about 3,000 to 50,000 centipoises.

This paint P can be coated uniformly over the delivery belt 5 with a thickness determined by its viscosity. It is noteworthy that the splash roll 14 functions not only to splash the paint onto the delivery belt but to agitate the paint within the vessel 27 thereby preventing the sedimentation of the aggregate suspended therein.

It will be seen from FIG. 3 that the vessel 27 is being constantly replenished with fresh paint P from the supply tank 28. The rate of this replenishment must correspond exactly with the rate of consumption of the paint within the vessel 27. This objective can be accomplished according to the invention by regulating the degree of opening of the aperture 30 at the bottom of the supply tank 28. The locking nuts 34, FIG. 1, may first be loosened and the adjusting rod 35 revolved manually to cause either clockwise or counterclockwise turn of the lever 33. In this manner the shutter plate 31 can be turned in the desired direction to regulate the aperture 30 to the desired degree of opening. The nuts 34 may then be retightened to retain the adjusting rod 35 and therefore the shutter plate 31 in the desired position.

The paint P which has been coated uniformly over the delivery belt 5 as aforesaid is thereby conveyed over the guide roll 6 and then the drive roll 3 and is scraped off by the slanting upper portion of the scraper plate 54. The paint is then allowed to stream down the vertical lower portion of the scraper plate 54 onto the supply plate 61. Since the paint P within the vessel 27 is being constantly coated over the delivery belt 5, the supply plate 61 receives a continuous supply of paint from the scraper plate 54.

The paint P streaming down the slanting supply plate 61 is then sprayed by the bristles of the revolving spray roll 37 downwardly in the substantially tangential direction of the spray roll in the form of droplets. The process of this paint spraying operation is such that the plant is first scraped off the supply plate 61 by the bristles of the spray roll 37, in such a manner that the paint adheres, instantaneously, to the respective bristles. The paint is then sprayed by centrifugal force and by the oscillation of the bristles against air resistance, aided further by high-velocity air stream taking place tangentially of the spray roll 37 due to its revolution. The advantage of the use of the spray roll 37 in the form of a brush is apparent in view of the fact that when the spray roll was replaced by one having a number of rounded, resilient projections over its entire circumference, so such "misting" of the paint took place.

The droplets of the paint are distributed evenly in the longitudinal direction of the spray roll 37 since the paint is supplied thereto in uniform thickness from the supply plate 61. The paint thus sprayed onto the surfaces of the successive work M traveling at a constant speed on the endless conveyor chains 68 forms coatings of uniform thickness thereon. The work M may be sheets of any such material as precast concrete, lightweight foamed concrete, slate, asbestos, calcium silicate, plywood, coagulated wood chips, and metal. The work M may be not only in the form of sheets but of any other desired shape.

When the paint of the above specified composition is in use, with its viscosity in the range of from about 30,000 to 50,000 centipoises, the paint was sprayed in the most favorable manner when the spray roll 37 with an outside diameter of 25 centimeters was rotated at the rate of about 1,000 revolutions per minute. The use of this paint has resulted in an unexpected advantage in that the dispersed particles of the aggregate are seen protuberantly on the white coatings on the surfaces of the work M, in a fashion comparable to the so-called lithin finish provided conventionally by the spray gun. The coatings of this character are particularly suitable on the external surfaces of buildings from the point of view of aesthetics.

It will be apparent that the slanting upper portion of the scraper plate 54 is urged against the delivery belt 5 in such a manner that the paint will be scraped off evenly and efficiently, without any undue resistance offered to the motion of the delivery belt. For thus regulating the degree of contact of the scraper plate 54 with the delivery belt 5, the nuts 60 should first be loosened to permit the adjusting rod 58 to be revolved manually relative to the bracket 59. The slanting upper portion of the scraper plate 54 can thus be turned in either direction for proper contact with the delivery belt 5. By succeedingly retightening the nuts 60, the scraper plate 54 can be held in the desired position since the lever 56 is urged into abutment against the adjusting rod 58 by the tension spring 57.

The position of the lower edge portion of the supply plate 61 relative on the spray roll 37 can likewise be controlled by first loosening the nuts 67 and by revolving the adjusting rod 65 relative to the bracket 66 to turn the lever 63 in either direction and through a desired angle. The supply plate 61 can thus be adjusted to the optimum angular position in which its lower edge portion will be in substantial contact with the circumference of the spray roll 37. The nuts 67 are then retightened, and as the lever 63 is urged into abutment against the adjusting rod 65 by the tension spring 64, the supply plate 61 can be held in the optimum position.

In the event that any irregularity is noted in the distribution of the droplets being sprayed onto the work M, due for example to the irregularity in the arrangement of the bristles on the spray roll 37 or to some defective property of the paint P, then the air cylinder 43, FIG. 4, should be set in operation to cause longitudinal reciprocation of the spray roll 37 relative to the supply plate 61. The irregular distribution of the paint droplets will then be automatically corrected.

For suspending the coating operation, the air cylinders 12 on both sides of the side walls 2 may be actuated simultaneously, thereby causing the levers 11 to turn clockwise as viewed in FIG. 1. The stopper plate 9, FIG. 3, is thus swung into forced contact with the delivery belt 5. Since the paint P applied on the delivery belt 5 turning over the dip roll 4 is now scraped off by the stopper plate 9, no paint is delivered to the spray roll 37 in spite of the sustained motion of the delivery belt. It will be apparent that the air cylinders 12 and 43 used in this particular embodiment of the invention are replaceable by hydraulic cylinders or other equivalent means, without in any way departing from the scope of this invention.

In the use of the spray coating apparatus according to the invention, the coatings formed on the work M by the spray roll 37 be of uniform thickness and unvarying consistency if the bristles of the spray roll are of equal length and equal resisliency and are arranged evenly over the entire circumference of its cylindrical core. However, the nature or appearance of the coatings is variable considerably by modifying the configuration of the spray roll 37, as set forth hereinbelow.

Figure 5:
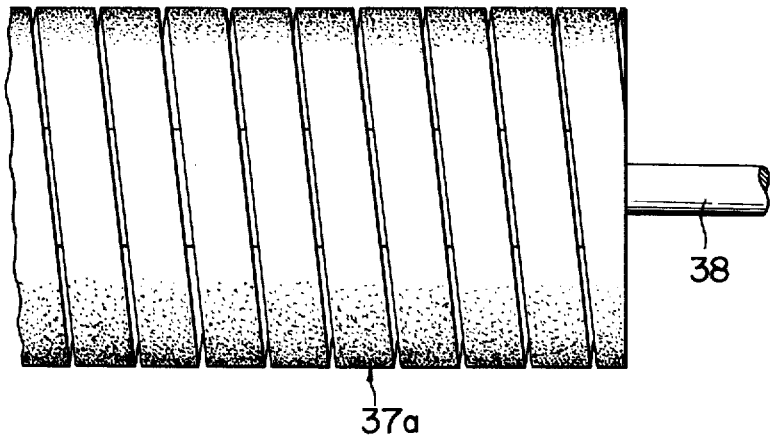
FIG. 5 is an enlarged, fragmentary view showing a modified example of the spray roll.

FIG. 5 illustrates an example of such modified spray roll which is adapted to form coatings of even more uniform thickness than those obtainable usually with the spray roll 37 of the above described configuration. The modified spary roll 37*a* also comprises a number of bristles planted in the circumference of its cylindrical core in dense, radial arrangement. These bristles, however, are not arranged over the entire circumference of the cylindrical core but in the form of a helix closely coiled around the same, with extremely small spacings between the adjoining turns of the helix. Thus, during rotation of the spray roll 37*a* around the shaft 38, its bristles will move as if they were shifting longitudinally of the spray roll at very high speed, thereby making possible the even more uniform spraying of the paint onto the work.

Figure 6:
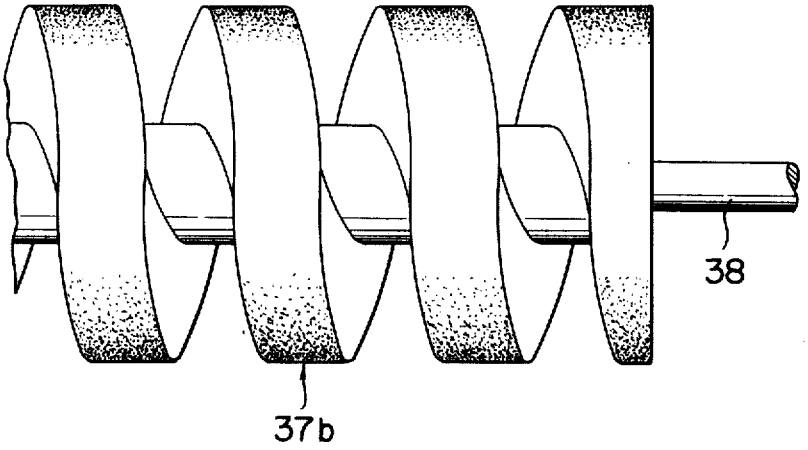
FIG. 6 is a similar view showing another modified example of the spray roll.

A similar modified example of spray roll 37*b* is illustrated in FIG. 6, in which the bristles are arranged in the form of a significantly coarser helix around the cylindrical core. The spacings between the adjoining turns of the helix may be at least equal to the width of the band of bristles constituting the helix. The coatings formed by this spray roll 37*b*, with the use of a paint of relatively high viscosity, will exhibit distinctive patterns delineated by the varying density of the paint droplets sprayed onto the work.

Figure 7:
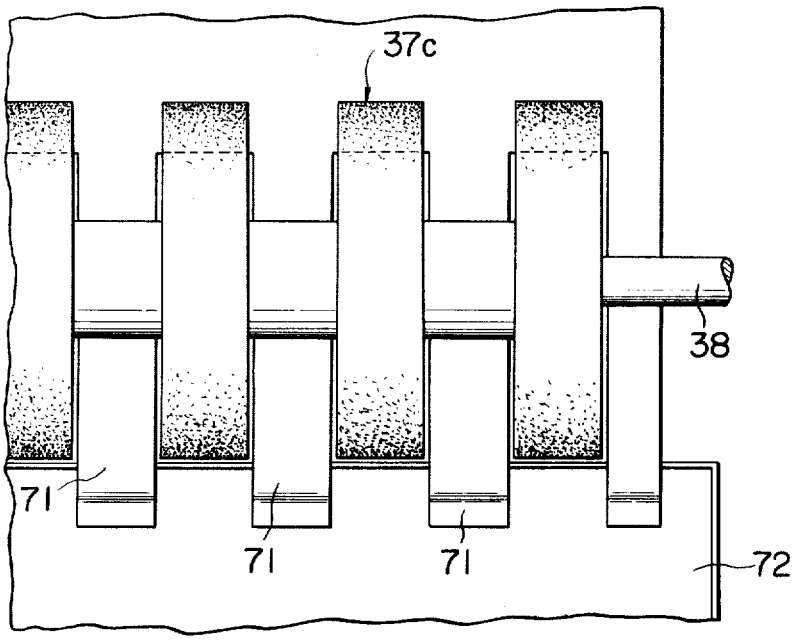
FIG. 7 is also a similar view showing a further modified example of the spray roll together with the corresponding modification of a supply plate.
Figure 8:
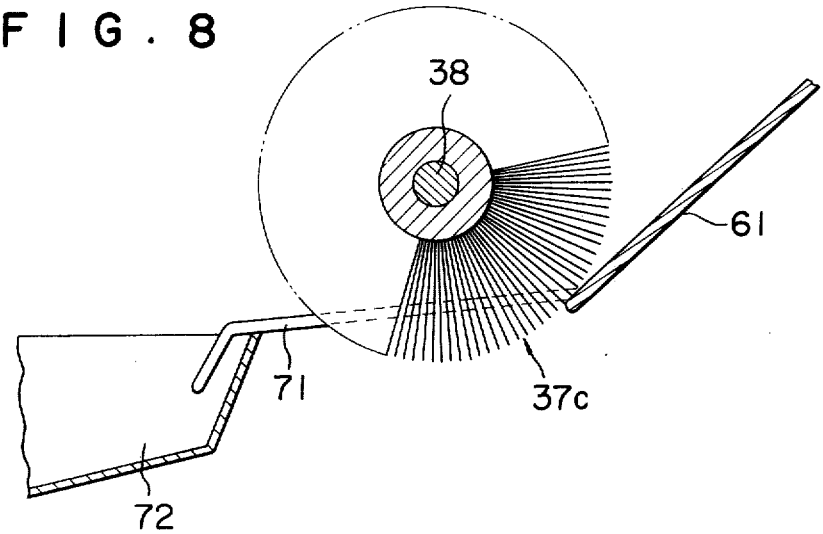
FIG. 8 is a side elevational view of the arrangement shown in FIG. 7.

Illustrated in FIGS. 7 and 8 is a further modified example of spray roll 37*c*, in which the bristles are arranged in the form of a plurality of annular bands which are spaced apart longitudinally of the cylindrical core. The spacings between the adjoining annular bands may also be at least equal to the width of each band. In this manner the paint which has been delivered onto the supply plate 61 will be sprayed onto the work only from those portions of the supply plate disposed opposite to the constantly spaced bands of bristles on the spray roll 37*c*, so that striped coatings will be formed on the work. In order to prevent the paint from dripping down through the spacings between the annular bands of bristles on the spray roll 37*c*, the supply plate 61 may be equipped with comblike extensions 71 passing through the spacings of the spray roll at a suitable angle to the plane of the horizon. The paint streaming down these comblike extensions 71 may be collected in a suitable receptacle 72 and may be recharged into the supply tank 28 shown in FIGS. 1 to 3. The spacings between the annular bands of bristles on this spray roll 37*c* can of course be made irregular or otherwise changed as desired, to obtain the corresponding change in the striped pattern of the coating on the work.

In a still further modified example of spray roll 37*d* shown in FIGS. 9 and 10, the bristles used in the foregoing spray rolls 37, 37*a*, 37*b* and 37*c* are replaced by strips of plate of suitably resilient material 73. These strips 73 are mounted radially on the cylindrical core at circumferential and axial spacings, the axial spacings between the strips being minimized in this particular example. When this spray roll 37*d* is used in the spray coating apparatus of FIGS. 1 to 3, in combination with a liquid paint of relatively high viscosity, the paint will be sprayed in rather coarse drops by each axially aligned row of the strips 73 in such a manner that the coating formed on the work will exhibit a distinctively undulating pattern. For the best results, the outer tips of the strips 73 on the spray roll 37*d* should be held in rather close sliding contact with the supply plate 61 because then the force with which the paint is sprayed by the resilient strips is intensified. As seen in FIG. 10, the resilience offered by the strips 73 may be controlled by rings 74 of a desired diameter secured to the respective radial groups of the strips in concentric relationship to the shaft 38.

It is to be understood that the spray rolls of various configurations set forth hereinbefore are merely explanatory of the diversified character of this invention. The objects of the invention can be accomplished by other types of spray rolls only if they have bristles or the like of suitable resiliency in substantial radial arrangement on cylindrical cores. Such bristles or equivalent means can be formed of metal, synthetic resin or any other suitable material. The various types of spray rolls according to the invention may be used interchangeably to vary the nature or appearance of the coatings on the successive work, without causing any undue interruption in the continuous spray coating operation made possible by the apparatus of the invention.

Figure 11:
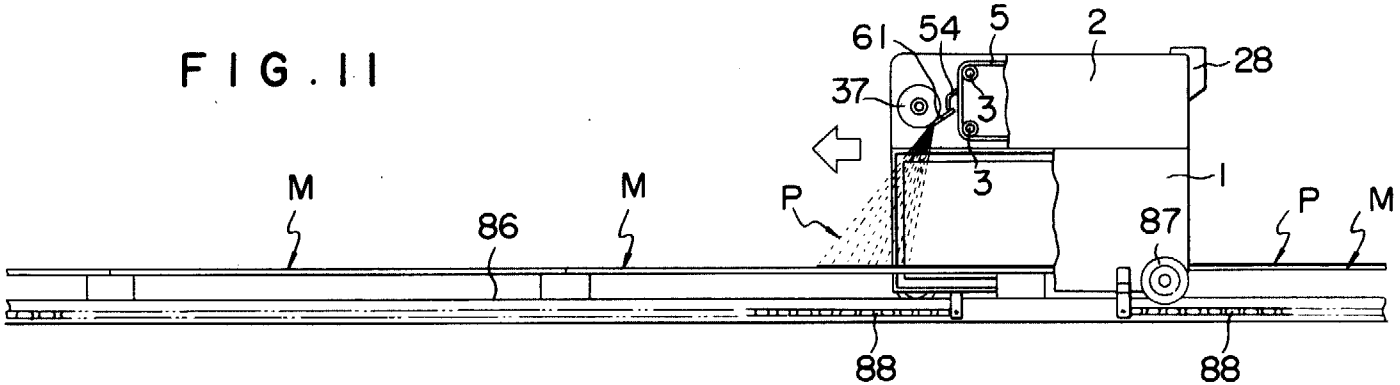
FIG. 11 is a partly broken away side elevational view showing a modified example of the spray coating apparatus illustrated in FIG. 1.

As illustrated in FIG. 11, the spray coating apparatus of FIGS. 1 to 3 is easily adaptable for coating the surfaces of objects which are either immovable or too bulky or heavy to be conveniently transported on chain conveyors or the like. Such objects include, for instance, the walls or other surfaces of buildings already completed and the unassembled concrete walls or other structural parts of prefabricated buildings. To this end, a pair of rails 86 may be laid out along the work M to be coated, as shown in FIG. 11, and the spray coating apparatus may be equipped with wheels 87 at the bottom end of its supporting frame 1 so as to run on the rails 86 at a constant speed by being driven through an endless chain 88 or the like. Other details of construction and operation of this movable spray coating apparatus will be apparent from the foregoing description of the example shown in FIGS. 1 through 3. It will also be appreciated that this movable apparatus is capable of coating not only horizontally disposed surfaces as in the drawing but vertical or slanting surfaces as well.

Figure 12:
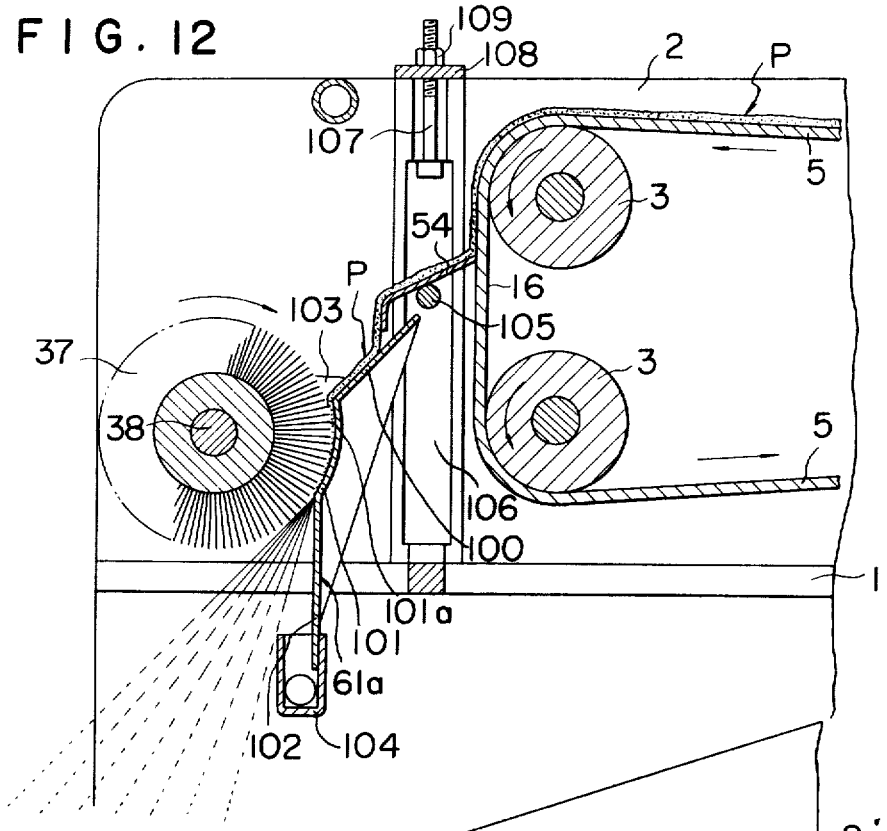
FIG. 12 is a fragmentary vertical sectional view of another preferred embodiment of the invention.

FIG. 12 illustrates a modification of the example shown in FIGS. 1, 2, and 3, which also comprises the supporting frame 1, the pair of side walls 2 mounted thereon, the vertically registered pair of rolls 3, the delivery belt 5, the spray roll 37 mounted on the shaft 38, and the scraper plate 54. The apparatus shown in FIG. 12 differs from that shown in FIGS. 1, 2, and 3 principally in the configuration of its supply plate 61*a*. The modified supply plate 61*a* comprises a slanting upper portion 100, a middle portion 101 of arcuate cross section, and a vertical downward extension 102. The arcuate middle portion 101 of the supply plate 61*a* is disposed substantially circumferentially of the spray roll 37 so as to extend through an arc of about 45°. The lower edge portion of the arcuate middle portion 101 is in contact with the tips of the bristles on the spray roll 37, whereas its upper edge portion is spaced a suitably small distance away from the circumference of the spray roll to leave a clearance 101*a*.

The supply plate 61*a* as a whole is supported at both ends by a pair of arms 103 which are pivotally connected to the inside surfaces of the respective side walls 2 so as to be turnable about the axis of the spray roll 37. The supply plate 61*a* is thus made angularly displaceable relative to the spray roll 37, for purposes hereinafter referred to.

An elongated open-top trough 104 is supported along the bottom edge of the downward extension 102 of the supply plate 61*a*. Although not seen in this figure, it is assumed that the trough 104 is inclined toward either of the side walls 2, and the lower end of the trough is open to a discharge conduit or the like.

The scraper plate 54 including the slanting upper portion and the vertical lower portion as in the preceding embodiment of FIGS. 1 to 3 is fixedly supported by a support rod 105 which is connected at both ends thereof to a pair of slide plates 106, respectively, in such a manner that the support rod 105 is turnable about its axis relative to the slide plates 106 to adjust the angular position of the scraper plate 54 relative to the delivery belt 5. The slide plates 106 are suitably mounted on the respective side walls 2 so as to be slidable up and down, and an externally screw threaded rod 107 is coupled at its lower end to the upper end of each slide plate 106 so as to be freely turnable relative to the latter. Each rod 107 extends through an internally screw threaded bore of a stationary member 108 on the top of each side wall 2, and a nut 109 is fitted over the projecting end of the rod 107 to retain the slide plate 106 and therefore the scraper plate 54 at a desired height. Other details of construction are as set forth above with reference to FIGS. 1 to 3 in particular.

In the operation of this example illustrated in FIG. 12, the liquid paint P which has been coated over the entire outer surface of the delivery belt 5 in the vessel 27 (FIG. 1) is thereby conveyed over the roll 3 down to the scraper plate 54. The paint P is then scraped off by the slanting upper portion of the scraper plate 54 and flows by gravity down onto the slanting upper portion 100 of the supply plate 61*a* and thence into the spacing 101*a* between the arcuate middle portion 101 of the supply plate and the circumference of the spray roll 37. The paint is then sprayed by the bristles of the revolving spray roll 37 from the lower edge of the arcuate middle portion 101 down onto the work, not shown, traveling at a constant speed through the supporting frame 1 as in the FIGS. 1 to 3 embodiment. The paint thus sprayed onto the work will be in the form of extremely fine droplets or mist because the high-velocity air streams produced tangentially of the spray roll 37 due to its revolution are such that the air which has been gradually compressed in the tapering spacing between the spray roll 37 and the arcuate middle portion 101 of the supply plate 61*a* is released instantaneously at the lower edge of the latter.

Any excess paint which has not been sprayed by the spray roll 37 will stream by gravity down the vertical extension 102 of the supply plate 61*a* and will be collected in the trough 104, perhaps for discharge at a point external to the apparatus. The direction in which the paint P is sprayed in the above described manner is veriable by angular displacement of the supply plate 61*a* around the axis of the spray roll 37. Upon readjustment of the angular position of the supply plate 61*a*, the height of the scraper plate 54 may also have to be readjusted correspondingly, by manipulating the means comprising the slide plates 106, the rods 107, the nuts 109 and so forth.

It will also be understood that the angle at which the scraper plate 54 is set with respect to the delivery belt 5 is variable as desired. Usually, however, the best results will be obtained when the scraper plate is at an angle of about 45° to the plane of the horizon. The transverse dimension of the arcuate middle portion 101 of the supply plate 61*a* may also be varied as required in relation, for example, to the configuration of the spray roll 37.

Figure 13:
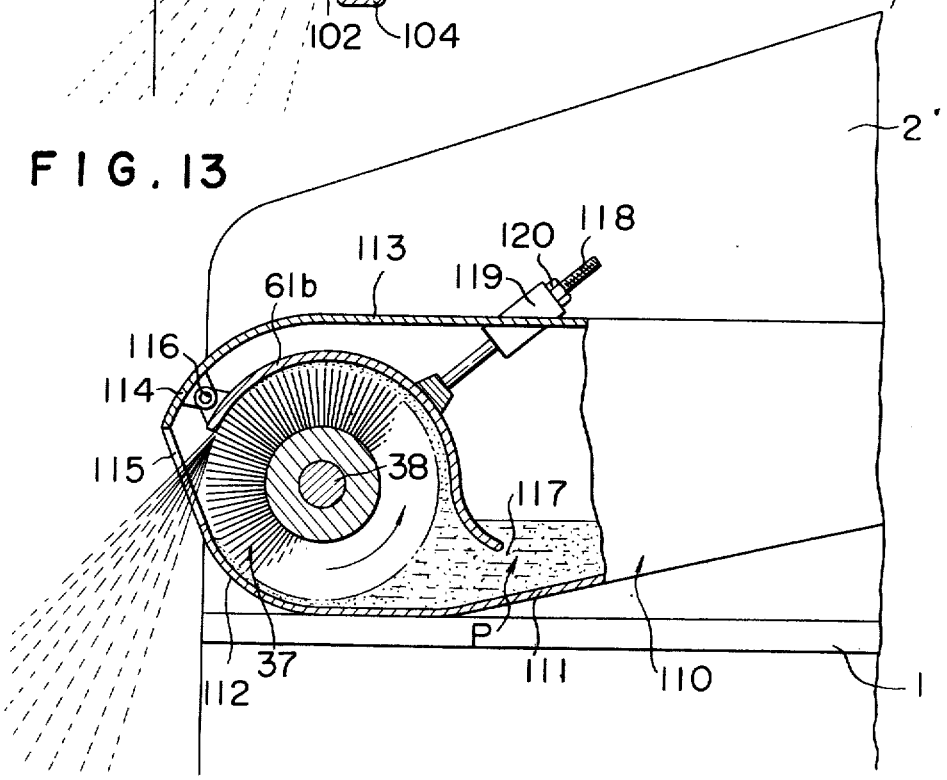
FIG. 13 is a similar view showing yet another preferred embodiment of the invention.

FIG. 13 illustrates another preferred embodiment of the invention, which is similar in principles to the preceding embodiment of FIG. 12. The spray coating apparatus of FIG. 13 also includes the spray roll 37 rotatably supported between the pair of side walls 2 on the supporting frame 1. As will be seen from the figure, the spray roll 37 is housed in an enclosure 110 adjacent its front end, seen to the left in FIG. 13. The enclosure 110 is adapted to accommodate the paint P in the form of a bulk liquid therein, and its bottom 111 is inclined upwardly toward the rear end. The front end portion 112 of the bottom 111 is curved along the circumference of the spray roll 37, with a slight spacing therebetween. The enclosure 110 includes a top cover 113 which also is curved at its front end portion 114 along the circumference of the spray roll 37, with an appropriate spacing therebetween. An aperture 115 is defined by the opposed edges of the curved top and bottom 114 and 112 through the front end of the enclosure 110.

Within the enclosure 110, a supply plate 61*b* of arcuate cross section is mounted over the spray roll 37. The front end of the supply plate 61*b* is pivotally connected at 116 to the curved front end portion 114 of the top cover 113 so that the supply plate will be held in contact with the circumference of the spray roll 37 at its front end portion only. The spacing between the supply plate 61*b* and the spray roll 37 gradually increases toward the rear end of the former. The rear end of the supply plate 61*b* is curved away from the spray roll 37 to form an entrance 117 through which the paint P will be guided into the tapering spacing between the supply plate and the spray roll due to the revolution of the latter taking place in the direction of the arrow in FIG. 13.

At least one externally screw threaded adjusting rod 118 is turnably coupled to the supply plate 61*b*. The adjusting rod 118 extends upwardly through a sleeve 119 secured to the top cover 113 of the enclosure 110, and a nut 120 is fitted over the exposed end of the adjusting rod 118. In this manner the spacing between the spray roll 37 and the supply plate 61*b* is made adjustable as required. It is assumed that during operation of the apparatus, the paint P is to be constantly introduced into the enclosure 110 from some external source, at such a rate that the paint will not overflow through the aperture 115 but that the spray 37 will be held partly immersed therein.

During operation of this spray coating apparatus of FIG. 13, the spray roll 37 is maintained in constant rotation in the arrow marked direction by any known or suitable drive mechanism. The paint P within the enclosure 110 is then pumped up into the spacing between the spray roll 37 and the supply plate 61*b* through the entrance 117, to be sprayed out of the enclosure through its front end aperture 115 by the bristles of the revolving spray roll. The paint thus sprayed onto the work which may be traveling at a constant speed through the supporting frame 1 will be in the form of extremely fine droplets, for reasons which will be apparent from the foregoing description of the embodiments of FIGS. 1 to 3 and FIG. 12.

In the arrangement of FIG. 13, the front end aperture 115 of the enclosure 110 is disposed so as to be substantially bisected by the horizontal plane passing the axis of the spray roll 37, and the supply plate 61*b* is mounted over the spray roll 37 in such a manner that the droplets of the sprayed paint will fly in a slanting direction. However, it is of course possible to so modify the positions of the aperture 115 and the front tip of the supply plate 61*b* relative to the spray roll 37 that the droplets will fly substantially vertically downward. In this case, the construction and positioning of the enclosure 110 must also be modified correspondingly, such modification being considered to be within the common knowledge of those skilled in the art.

Figure 14:
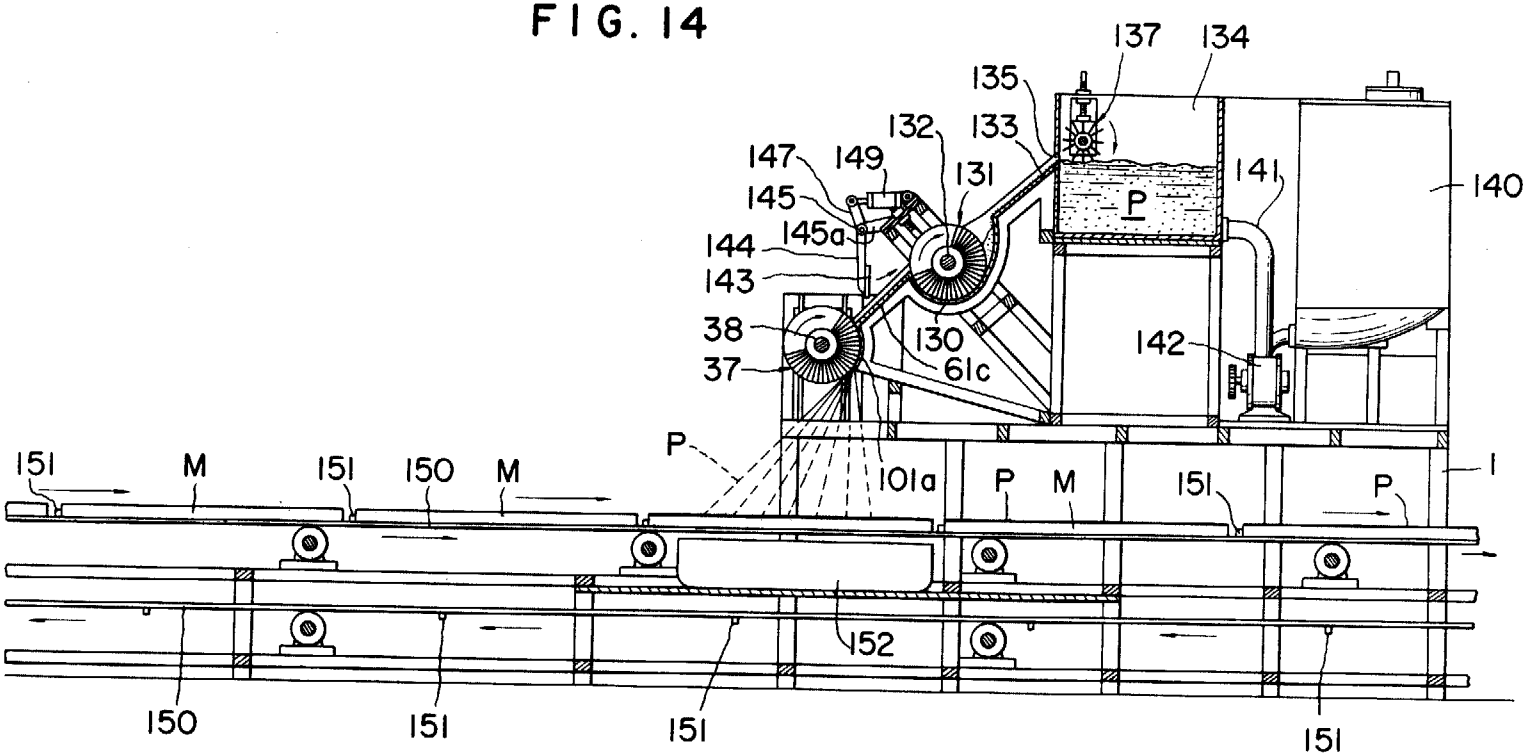
FIG. 14 is a side elevational view, partly in section, of a further preferred embodiment of the invention.
Figure 15:
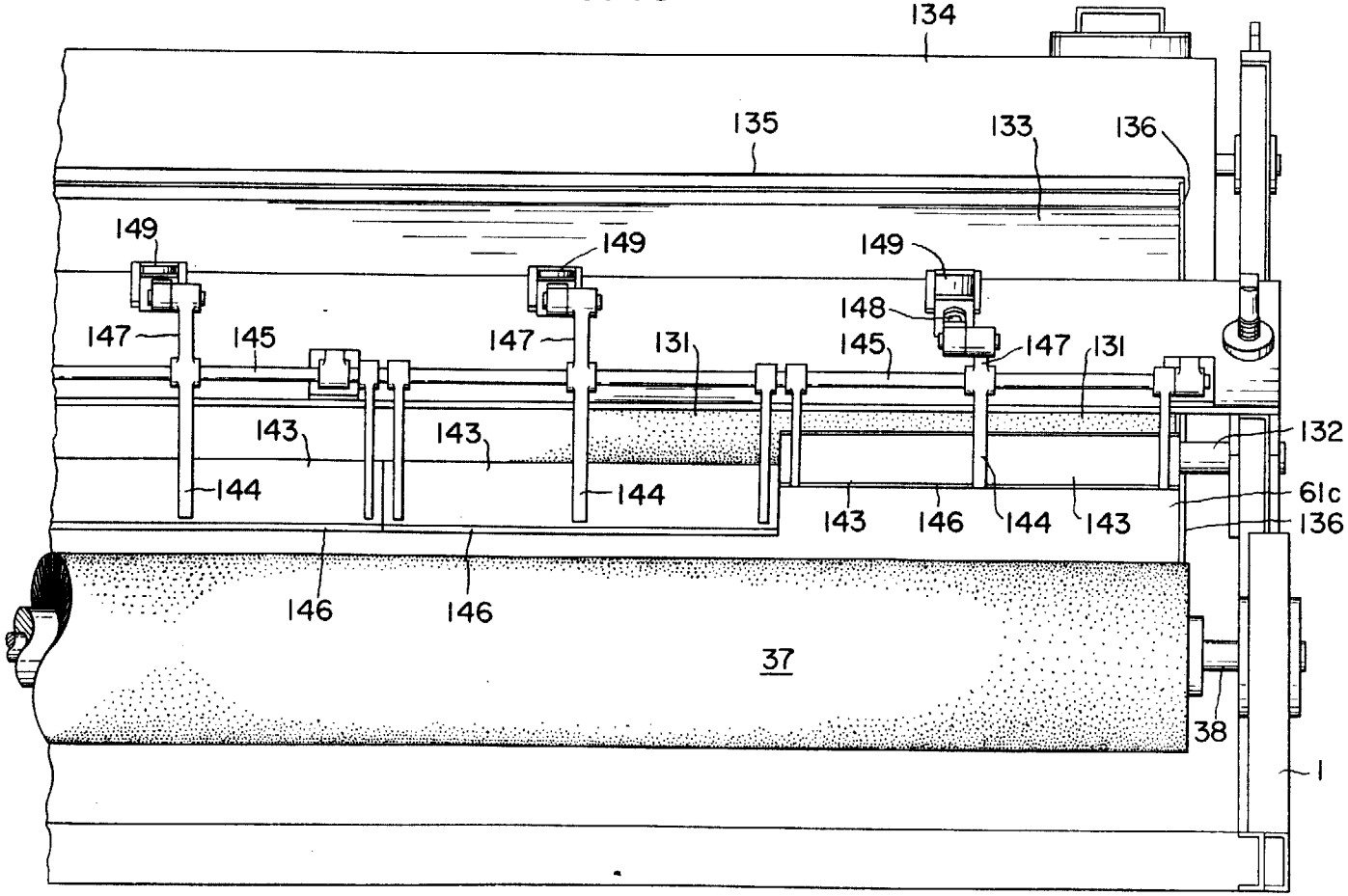
FIG. 15 is an enlarged, fragmentary front elevational view of some essential parts of the example shown in FIG. 14.
Figure 16:
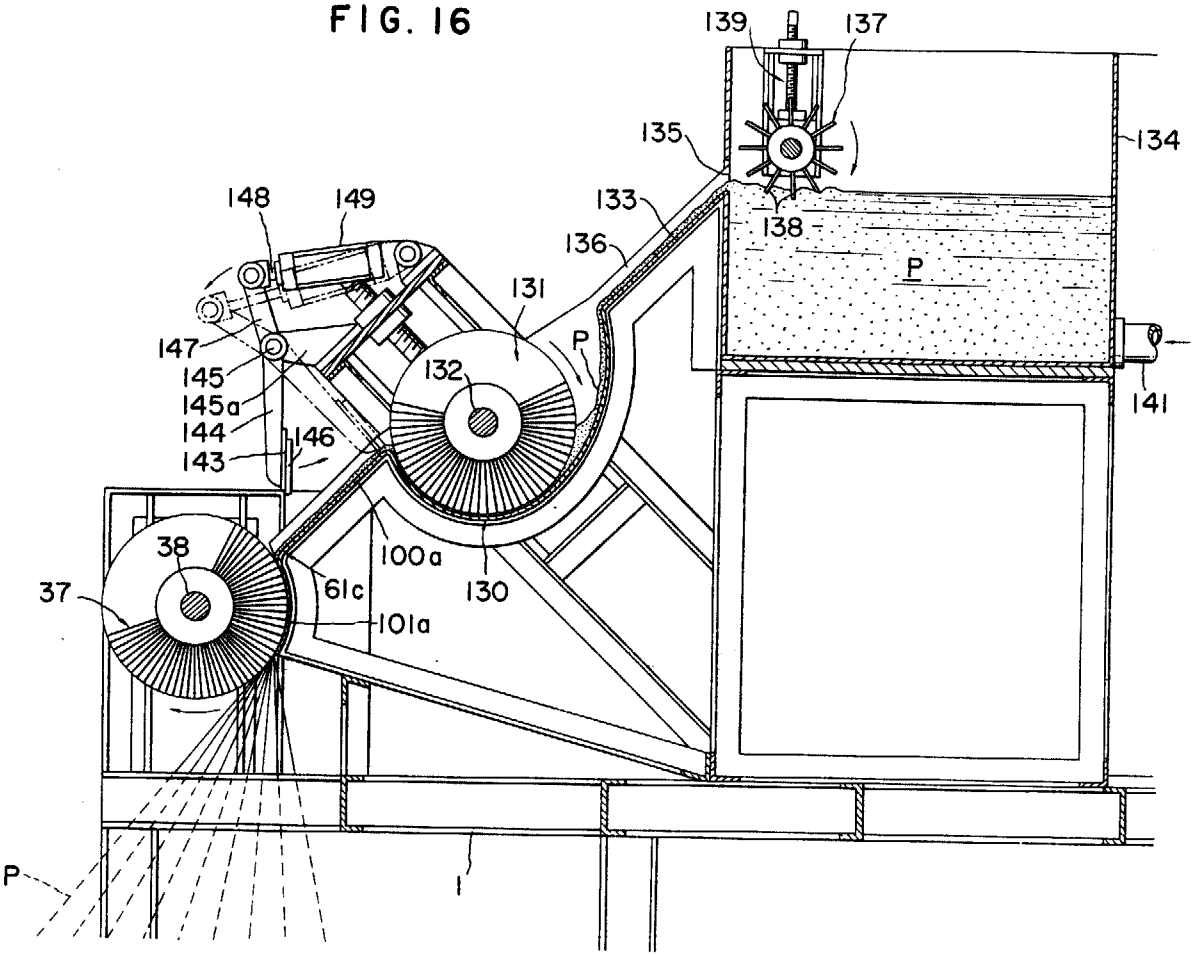
FIG. 16 is a side elevational view, partly in section, of the arrangement shown in FIG. 15.

FIGS. 14, 15, and 16 illustrate a further preferred embodiment of the invention, in which the spray roll 37 is likewise rotatably supported horizontally over the supporting frame 1. A supply plate 61*c* comprising a slanting upper portion 100*a* and a lower portion 101*a* of arcuate cross section, as indicated in FIG. 16, is fixedly supported on the rear side of the spray roll 37. The arcuate lower portion 101*a* of the supply plate 61*c* is disposed substantially circumferentially of the spray roll 37 so as to extend through an arc of up to about 90°. As in the preceding embodiments of FIGS. 12 and 13, the arcuate lower portion 101*a* of the supply plate may have its lower edge portion only in substantial contact with the tips of the bristles on the spray roll 37.

The slanting upper portion 100*a* of the supply plate 61*c* is joined at its upper or rear edge to the front edge of a paint receptacle 130 of substantially arcuate cross section which also is fixedly supported over the supporting frame 1. Accommodated in this paint receptacle 130 is a delivery roll 131 which is identical in configuration to the spray roll 37. As best seen in FIG. 16, the front portion of the paint receptacle 130 is arched concentrically with the delivery roll 131 and is held in substantial contact therewith, whereas the rear portion of the paint receptacle is spaced a suitable distance away from the circumference of the delivery roll 131. The delivery roll 131 is rotatable on a shaft 132 which is supported horizontally over the supporting frame 1 in such a manner that the position of the delivery roll is made adjustable with respect to the paint receptacle 130 in a direction at right angles with the plane of the slanting upper portion 100*a* of the supply plate 61*c*.

The paint receptacle 130 has its rear edge joined to the front edge of a slanting delivery plate 133 which in turn is joined at its rear edge to a paint vessel 134 containing the paint P in the form of a bulk liquid therein. The paint P within the vessel 134 is to overflow through its horizontally elongated aperture 135 onto the delivery plate 133. It will be noted from FIGS. 14 and 16 that the upper portion of the supply plate 61*c*, the paint receptacle 130 and the delivery plate 133 are generally disposed at the same angle to the plane of the horizon. A pair of side walls 136 are erected continuously from both ends of the aperture 135 of the vessel 134 down to the front edge of the slanting upper portion 100*a* of the supply plate 61*c*.

Within the vessel 134 a feed wheel 137 is rotatably supported adjacent the aperture 135, the feed wheel 137 having a plurality of blades 138 in radial arrangement which can be at least partly dipped into the paint P within the vessel. As indicated at 139 in FIGS. 14 and 16, the feed wheel 137 may be equipped with any suitable means for adjusting its position vertically with respect to the level of the paint P. As shown in FIG. 14, a replenishing vessel 140 is fixedly supported over the supporting frame 1 on the rear side of the vessel 134, the vessels 134 and 140 being communicated via a conduit 141 having a pump 142 of suitable type adapted to force the paint from the latter to the former.

As will be seen from FIGS. 15 and 16 in particular, a plurality of stopper plates 143 of equal length are fixedly supported by levers 144 in close horizontal alignment over the slanting upper portion 100*a* of the supply plate 61*c*. The levers 144 are turnably supported at their respective upper ends by a stationary shaft or pin 145 on a stationary bracket 145*a*, in such a manner that when actuated by means hereinafter explained, the stopper plates 143 will swing into contact with the rear edge of the slanting upper portion 100*a* of the supply plate 61*c*, as indicated by the dot-and-dash lines in FIG. 16, thereby preventing the paint P from being fed down onto the same from the paint receptacle 130. The stopper plates 143 may each have an overlay 146 of rubber or like resilient material which includes a portion projecting downwardly therefrom, to assure their close contact with the rear edge of the slanting upper portion of the supply plate 61*c*. Each of the levers 144 has an integral arm 147 the free end of which is pivoted to a piston rod 148 of a pneumatic or hydraulic power cylinder 149 fixedly supported over the supporting frame 1. Thus, by actuating the respective power cylinders 149, the corresponding stopper plates 143 can be swung individually between their operative and inoperative positions, as hereinafter referred to in more detail.

Referring again to FIG. 14, conveyor means in the form of an endless conveyor belt 150 extends through the supporting frame 1 at right angles with the axis of the spray roll 37. A plurality of transverse ridges 151 may be formed on the working surface of the conveyor belt 150 at desired constant spacings. A sump 152 may be mounted between the upper and lower sides of the conveyor belt 150 in substantially vertical registration with the spray roll 37.

For operating the spray coating apparatus of FIGS. 14 to 16, the liquid paint P of suitable viscosity is charged into the replenishing vessel 140. The spray roll 37, the delivery roll 131 and the feed wheel 137 are then set in rotation in their respective direction of rotation indicated by the arrows in FIGS. 14 and 16, by drive means not shown in the drawings. The pump 142 is also actuated to initiate the continuous supply of the paint P from the vessel 140 to the vessel 134 via the conduit 141. The piston rods 148 of the respective power cylinders 149 must be in their restracted position so that the stopper plates 143 are held in their inoperative position away from the rear edge of the slanting upper portion 100*a* of the supply plate 61*c*.

The paint P which has been pumped up into the vessel 134 is discharged by overflow through the aperture 135 onto the delivery plate 133. This overflow of the paint onto the delivery plate 133 is aided by the revolving blades 138 of the feed wheel 137 because the paint may be of considerably high viscosity. The paint P flows by gravity down the delivery plate 133 into the receptacle 130 of arcuate cross section, from which the paint is scraped out, so to say, by the bristles or the like of the delivery roll 131 in constant rotation. Further flowing by gravity down the slanting upper portion 100*a* of the supply plate 61*c*, the paint is supplied continuously onto the arcuate lower portion 101*a* of the supply plate, to be sprayed by the spray roll 37 down onto the surfaces of the successive work M traveling at a constant speed on the conveyor belt 150 in the direction of the arrows in FIG. 14, the successive work bing retained in their respective positions on the conveyor belt by its transverse ridges 151. The paint can be sprayed in the form of extremely fine droplets for reasons set forth previously with reference to FIG. 12.

According to the arrangement of FIG. 14, it is possible to deliver the paint into the vessel 134 at an irregular feed rate depending upon the type of the pump 142 in use. Furthermore, the revolving blades 138 of the feed wheel 137 tend to produce waves on the surface of the paint within the vessel 134. The result will be a pulsating or irregular flow of the paint down the delivery plate 133. Such irregular paint flow, however, can be eliminated as the paint is pooled temporarily in the receptacle 130, from which the paint is discharged constantly by the revolving delivery roll 131 so as to form a layer of uniform thickness over the entire surface of the supply plate 61*c*. The droplets of the paint sprayed by the spray roll 37 will thus be of equal distribution throughout the axial length of the spray roll.

The thickness as well as appearance of the coatings thus formed on the surfaces of the successive work M can be varied by suitably regulating the rate of delivery of the paint P by the pump 142 and hence the rate of overflow of the paint through the aperture 135 of the vessel 134 and, in relation to such regulated rate of paint overflow, by controlling the revolving speed of the delivery roll 131. The same objective can further be accomplished by changing the revolving speed of the spray roll 37, by changing the traveling speed of the work M in relation to the amount of the paint sprayed per unit length of time, or by changing the viscosity or composition of the paint itself.

For suspending the operation of the apparatus, all of the power cylinders 149 supported above the delivery roll 131 is actuated simultaneously to swing the stopper plates 143 toward the delivery roll, so that the lower edges of the resilient overlays 146 secured to the respective stopper plates are forced into contact with the rear edge of the slanting upper portion 100*a* of the supply plate 61*c*. The paint is then no longer delivered onto the supply plate 61*c* in spite of the sustained rotation of the delivery roll 131.

Figure 17A:
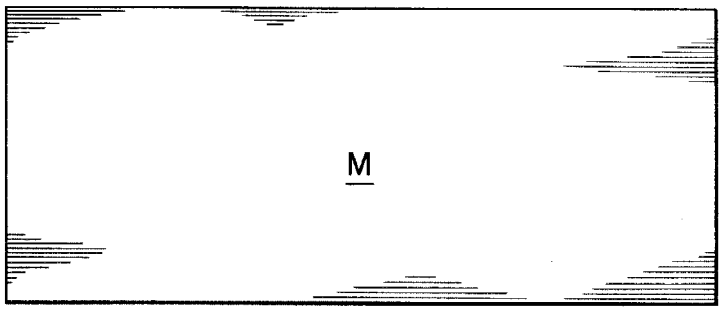
FIGS. 17A through 17D, inclusive, illustrate various types of work to be coated by the apparatus shown in FIG. 14.
Figure 17B:
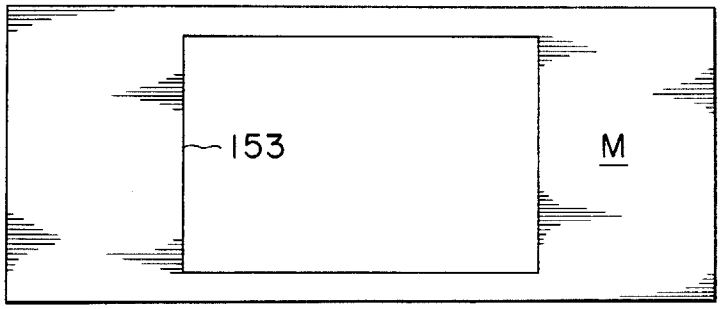
Figure 17C:
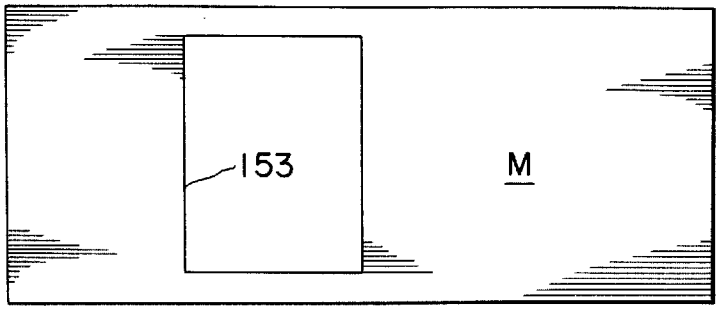

If the work M to be coated is a sheet of any of the materials listed previously, with a length approximately equal to the axial length of the spray roll 37, and if the entire surface of this work is to be coated, as illustrated in FIG. 17A by way of example, then the stopper plates 143 may all be held in their inoperative position, indicated by the solid lines in FIG. 16, during the spray coating operation. In case, however, the work M has a window 153 or like aperture therethrough, as shown in FIGS. 17B and 17C, any required one or more of the stopper plates 143 may be swung into the operative position when such window 153 or the like of the work traveling on the conveyor belt 150 is about to reach the forward extremity of the range where the sprayed droplets of the paint reach the surface of the conveyor belt. The aforesaid one or more stopper plates may be returned to their inoperative position when the window 153 is about to pass the rear extremity of the coating range. In this manner the paint can be prevented from being sprayed onto the 153 in the successive work. It will be apparent to those skilled in the art that such operation of the stopper plates 143 and therefore of the power cylinders 149 can be performed automatically in accordance with a predetermined program, by use of control equipment well known to the specialists. This will save the amount of the paint consumed and will further prevent the unnecessary soiling of the surface of the conveyor belt 150.

Figure 17D:
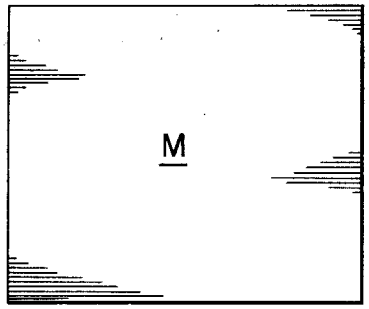

If the work M to be coated is considerably shorter than the axial length of the spray roll 37, as shown in FIG. 17D, then only those of the stopper plates 143 corresponding to the transverse length of such work M on the conveyor belt 150 may be held in their inoperative position while the other stopper plates are swung into contact with the rear edge of the supply plate 61*c*. The paint will then be sprayed only onto the surface of the work M.

In the practical application of this spray coating apparatus, all the stopper plates 143 may not necessarily be of equal length as in FIG. 15. Instead, the length of the respective stopper plates may be varied as required in accordance with the dimensions of the work to be coated. It should further be understood that the paint receptacle 130 and the delivery roll 131 are provided to eliminate any irregularity in the flow rate of the paint from the vessel 134. These means can be dispensed with if no such irregularity is present in the flow rate of the paint from the vessel 134, due for example to the method of replenishment of the vessel 134, to the configuration of the vessel 134, or to the composition or viscosity of the paint P. The slanting upper portion 100*a* of the supply plate 61*c* may than be joined directly to the vessel 134, and the stopper plates 143 may be caused to open or close the aperture 135 of the vessel 134.

Figure 18:
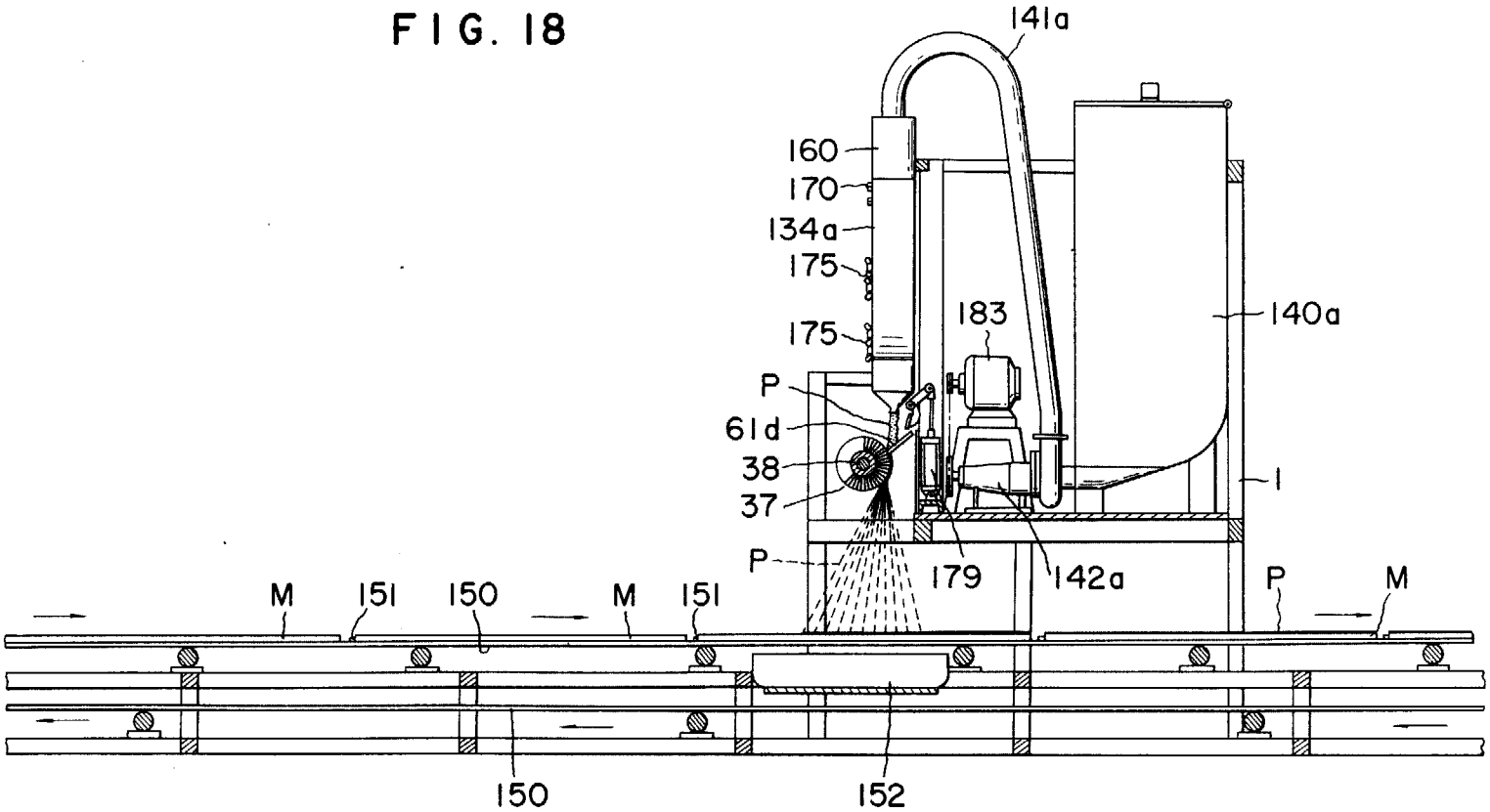
FIG. 18 is a partly broken away side elevational view of a still further preferred embodiment of the invention.
Figure 19:
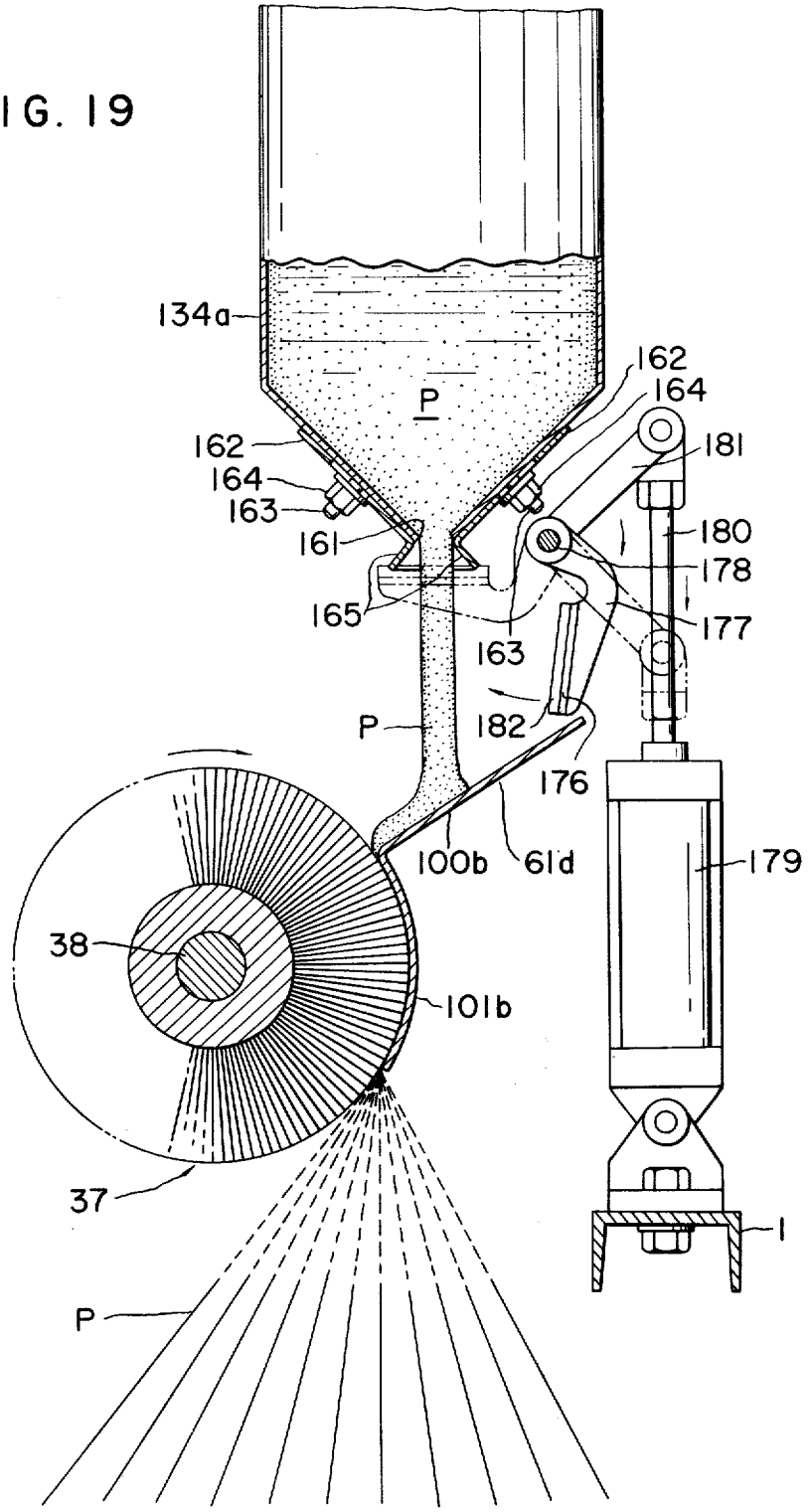
FIG. 19 is an enlarged, fragmentary side elevational view, partly in section, of some essential parts of the example shown in FIG. 18.
Figure 20:
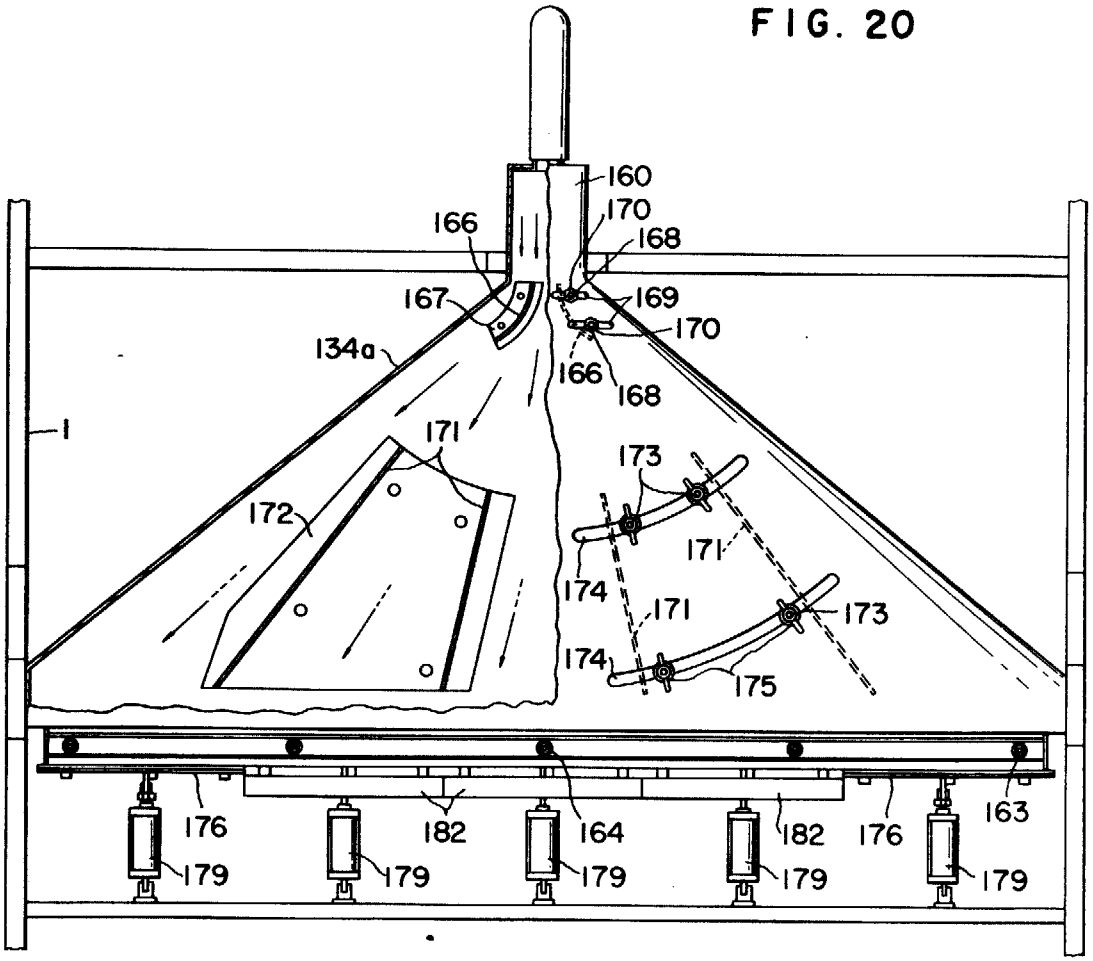
FIG. 20 is an enlarged, fragmentary front elevational view, partly in section, of a paint supply vessel and related means in the embodiment shown in FIG. 18.

FIGS. 18 to 20 illustrate a further preferred embodiment of the invention which also includes the spray roll 37 rotatably supported over the supporting frame 1. As in the preceding embodiment of FIGS. 14 to 16, a supply plate 61*d* comprising a slanting upper portion 100*b* and a lower portion 101*b* of arcuate cross section is fixedly supported on the rear side of the spray roll 37, as best seen in FIG. 19. The arcuate lower portion 101*b* of the supply plate 61*d* is disposed circumferentially of the spray roll 37 in substantial contact therewith so as to extend through an arc of up to about 90°.

A paint supply vessel 134*a* is fixedly supported above the slanting upper portion 100*b* of the supply plate 61*d*. As will be seen from FIGS. 18 and 20 in particular, the vessel 134*a* is of generally flat, rectangular shape, having a width at its lower end equal to the axial length of the spray roll 37. The vessel 134*a* has a tubular paint inlet 160 at its top, whereas the lower end of the vessel tapers into a paint outlet 161 (FIG. 19) extending parallel to the axis of the spray roll 37. A pair of elongate outlet regulator plates 162 are slidably attached to the respective slanting bottom walls on the front and rear sides of the paint outlet 161. Although not clearly seen in the drawings, the outlet regulator plates 162 are slotted at approximately constant longitudinal spacings to loosely receive bolts 163 affixed to the slanting bottom walls of the vessel 134*a*. Nuts 164 are fitted over the respective bolts 163 to retain the outlet regulator plates 162 in their correspondingly adjusted positions. It will be noted from FIG. 19 that each outlet regulator plate 162 has its lower edge 165 bent outwardly at an angle of about 90°.

As illustrated in FIG. 20, a pair of curved upper paint guides 166 are provided within the vessel 134*a* adjacent its tubular paint inlet 160. Each of these upper guides 166 is supported at its front and rear edges by support plates 167 which in turn are each supported by a pair of substantially vertically spaced bolts 168 projecting out of the vessel through respective horizontal slots 169. Thus, a total of four such horizontal slots 169 are formed in each of the front and rear walls of the vessel 134*a*, so that the positions of the respective upper paint guides 166 are displaceable horizontally by moving the bolts 168 along the slots 169. Nuts 170 are fitted over the projecting ends of the respective bolts 168 to securely retain the upper paint guides 166 in their desired positions.

Two pairs of lower paint guides 171 are also provided within the vessel 134*a* adjacent the paint outlet 161, in such arrangement that the paint will be distributed evenly throughout the length of its bottom end. Each pair of lower paint guides 171 are supported at their front and rear edges by a pair of support plates 172 respectively which in turn are each supported by a plurality of, four in this embodiment, spaced apart bolts 173 projecting out of the vessel 134*a* through a pair of arcuate slots 174 in concentric arrangement. Nuts 175 are fitted over the projecting ends of the respective bolts 173. The positions of the lower paint guides 171 are thus also made adjustable so that the paint will be discharged evenly from the elongate paint outlet 161 of the vessel.

As seen in FIGS. 19 and 20, a plurality of stopper plates 176 of equal length are each supported by a plurality of arms 177 loosely mounted on a stationary shaft or pin 178, in such a manner that the stopper plates 176 are individually swingable into and out of contact with the outwardly bent lower edges 165 of the outlet regulator plates 162 to close or open the corresponding parts of the paint outlet 161 as required. Such swinging motion of the stopper plates 176 is made possible by a plurality of pneumatic or hydraulic power cylinders 179 provided correspondingly to the respective stopper plates. Each power cylinder 179 has its piston rod 180 turnably coupled to one end of a lever 181 the other end of which is rigidly coupled to one of the arms supporting each stopper plate 176 besides being loosely mounted on the rod 178. In order to ensure liquid-tight closure of the paint outlet 161, the stopper plates 176 may each have an overlay 182 of rubber or like resilient material.

As seen in FIG. 18, the inlet 160 of the vessel 134*a* is connected to one end of a conduit 141*a* which is connected at the other end to a replenishing vessel 140*a* via a pump 142*a* of suitable type. The pump 142*a* may be driven by an electric motor 183 mounted on the supporting frame 1. As in the preceding embodiment of FIGS. 14 to 16, conveyor means in the form of an endless belt 150 extends through the supporting frame 1 at right angles with the axis of the spray roll 37, the conveyor belt 150 having a plurality of transverse ridges 151 thereon at desired constant spacings. The sump 152 may also be mounted between the upper and lower sides of the conveyor belt 150 in substantially vertical registration with the spray roll 37.

In operation, the paint P in the form of a bulk liquid of suitable viscosity is charged into the replenishing vessel 140*a*. The operation of the pump 142*a* is then initiated by setting the motor 183 in rotation, and the spray roll 37 is also set in rotation in the direction of the arrow in FIG. 19 by drive means not shown in the drawings. The power cylinders 179 may also be operated to turn the respective stopper plates 176 in their positions indicated by the solid lines in FIG. 19, thereby opening the paint outlet 161 of the vessel 134*a*.

The paint P which has been pumped up into the vessel 134*a* through its tubular inlet 160 flows down as directed by the upper and lower guides 166 and 171, in such a manner that the paint will be discharged substantially uniformly out of the elongate outlet 161 of the vessel. It will be understood that the rate of this paint discharge out of the vessel outlet 161 is substantially less than the feed rate of the paint by the pump 142*a*, so that the paint within the vessel 134*a* is subject to some internal pressure. In the event that any irregularity is noted in the longitudinal distribution of the paint being thus discharged out of the vessel outlet 161, the nuts 170 and 175 on the respective bolts 168 and 173 can be loosened for readjustment of the upper and lower paint guides 166 and 171, respectively, within the vessel 134*a*.

Upon discharge from the vessel outlet 161, the paint P drops directly onto the slanting upper portion 100*b* of the supply plate 61*d*, as best illustrated in FIG. 19, and is thence continuously fed by gravity down onto its arcuate lower portion 101*b*, to be sprayed by the revolving spray roll 37 down onto the surfaces of the successive work M traveling at a constant speed on the conveyor belt 150. The width of the elongate paint outlet 161 at the bottom of the vessel 134*a* may be regulated by the outlet regulator plates 162 in accordance with the viscosity or composition of the paint P in use or with the desired thickness of the coatings on the successive work M. The outlet regulator plates 162 can be moved up and down relative to the slanting bottom walls of the vessel 134*a* simply by loosening the nuts 164 on the bolts 163.

For suspending the spray coating operation, the power cylinders 179 may all be actuated to move their piston rods 180 to the retracted position indicated by the dot-and-dash lines in FIG. 19. The levers 181 will then be turned clockwise on the rod 178 as seen in the drawing, with the result that the stopper plates 176 on the free ends of the arms 177 are all turned into contact with the outwardly bent lower edges 165 of the outlet regulator plates 162 via their respective overlays 182 thereby closing the outlet 161 of the vessel 134*a*.

As in the preceding example shown in FIGS. 14, 15, and 16, the power cylinders 179 can be actuated selectively to close only the desired parts of the vessel outlet 161 by the corresponding stopper plates 176, so that the paint P will be sprayed only onto the required parts of the successive work M, as shown in FIGS. 17B and 17C, or onto the entire surface of the work which is shorter in width than the axial length of the spray roll 37, as shown in FIG. 17D. Such selective spray coating operation can of course be fully automated by means of program controlled apparatus well known to the specialists.

We claim:

1. A spray coating apparatus comprising, in combination:

a supporting frame;

a first vessel fixedly mounted on said supporting frame, said vessel containing a coating agent in the form of a bulk liquid;

a second vessel also fixedly mounted on said supporting frame;

means for continuously supplying the coating agent from said frist to said second vessel at a prescribed rate;

a spray roll rotatably mounted over said supporting frame, said spray roll comprising a cylindrical core and a number of resilient elements of slender shape extending radially from the circumference of said cylindrical core;

a supply plate mounted along said spray roll, said supply plate comprising a slanting upper portion and a lower portion of arcuate cross section, said lower portion of said supply plate being disposed along the circumference of said spray roll in such a manner that said lower portion is held in substantial contact with said spray roll at least along its lower edge; and delivery means for continuously delivering the coating agent from said second vessel onto said slanting upper portion of said supply plate wherein said delivery means comprises:

a slanting delivery plate onto which the coating agent is continuously supplied by overflow from said first vessel;

a receptacle of substantially arcuate cross section generally extending parallel to the axis of said spray roll and having one edge joined to the lower edge of said delivery plate and the opposite edge joined to the upper edge of said upper portion of said supply plate; and a delivery roll rotatably mounted in said receptacle so as to extend parallel to the axis of said spray roll, said delivery roll also comprising a cylindrical core and a number of resilient elements of slender shape extending radially from the circumference of said cylindrical core;

whereby upon rotation of said delivery roll in a predetermined direction, the coating agent which has been delivered into said receptacle from said delivery plate is fed out onto said upper portion of said supply plate in the form of a layer of unvarying thickness;

whereby the coating agent is sprayed onto work away from said lower edge of said lower portion of said supply plate by said spray roll.

2. A spray coating apparatus as defined in claim 1, further including stopper means which when actuated, is capable of preventing the flow of the coating agent down said upper portion of said supply plate, thereby causing the apparatus to suspend the spray coating operation.

3. A spray coating apparatus as defined in claim 2, wherein said stopper means comprises a plurality of stopper plates each swingably supported above said upper portion of said supply plate, said stopper plates generally extending parallel to the axis of said spray roll, and means for individually actuating the respective stopper plates into close contact with the upper edge portion of said upper portion of said supply plate.

4. An apparatus for spray coating a relatively viscous liquid coating agent onto a work, comprising a spray roll having a number of resilient elements of slender shape extending radially from the circumference thereof and driven in rotation about a horizontal axis, a sloping coating agent supply plate disposed along said spray roll in such a manner that the supply plate is held in substantial contact with the spray roll at least along the lower horizontal edge thereof, and coating agent delivery means disposed at a position to deliver the coating agent onto said supply plate at an upper part thereof to cause the coating agent to flow down the supply plate to said lower edge to be sprayed onto the work away from said lower edge by said spray roll, said coating agent delivery means comprising a coating agent vessel located at a position to deliver the coating agent to the upper edge of the supply plate and containing the coating agent therein, said vessel having an aperture through which the coating agent in the vessel is supplied by overflowing it to flow down the supply plate, a feed wheel disposed in said vessel adjacent said aperture and mounted for rotation about a horizontal axis, said feed wheel being dipped partially in the coating agent to cause the overflowing of the coating agent through said aperture, and a replenishing vessel connected to said coating agent vessel through a conduit with a pump to supply the coating agent into the coating agent vessel.

5. A spray coating apparatus as defined in claim 4, further including stopper means which, when actuated, is capable of preventing the flow of the coating agent down said supply plate, thereby causing the apparatus to suspend the spray coating operation.

6. A spray coating apparatus as defined in claim 5, wherein said stopper means comprises a plurality of stopper plates each swingably supported above said supply plate, said stopper plates generally extending parallel to the axis of said spray roll, and means for individually actuating the respective stopper plates into close contact with said supply plate.

7. An apparatus for spray coating a relatively viscous liquid coating agent onto a work, comprising a spray roll having a number of resilient elements of slender shape extending radially from the circumference thereof and driven in rotation about a horizontal axis, a sloping coating agent supply plate disposed along said spray roll in such a manner that the supply plate is held in substantial contact with the spray roll at least along the lower horizontal edge thereof, and coating agent delivery means disposed at a position to deliver the coating agent onto said supply plate at an upper part thereof to cause the coating agent to flow down the supply plate to said lower edge to be sprayed onto the work away from said lower edge by said spray roll, said coating agent delivery means comprising a coating agent vessel located at a position to deliver the coating agent to the upper edge of the supply plate and containing the coating agent therein, said vessel having an aperture through which the coating agent in the vessel is supplied by overflowing it to flow down the supply plate, and a feed wheel disposed in said vessel adjacent said aperture and mounted for rotation about a horizontal axis, said feed wheel being dipped partially in the coating agent to cause the overflowing of the coating agent through said aperture, and the apparatus further comprising stopper means which, when actuated, is capable of preventing the flow of the coating agent down said supply plate, thereby causing the apparatus to suspend the spray coating operation.

8. A spray coating apparatus as defined in claim 7, wherein said stopper means comprises a plurality of stopper plates each swingably supported above said supply plate, said stopper plates generally extending parallel to the axis of said spray roll, and means for individually actuating the respective stopper plates into close contact with said supply plate.

* * * * *